US012741314B2

(12) United States Patent
Barati Sedeh et al.

(10) Patent No.: US 12,741,314 B2
(45) Date of Patent: Sep. 22, 2026

(54) TWO-STEP THERMAL TREATMENT OF NICKEL-CONTAINING SULFIDES FOR THE PRODUCTION OF FERRONICKEL

(71) Applicant: THE GOVERNING COUNCIL OF THE UNIVERSITY OF TORONTO, Toronto (CA)

(72) Inventors: Mansoor Barati Sedeh, Toronto (CA); Samuel Walton Marcuson, Mississauga (CA); Fanmao Wang, Toronto (CA)

(73) Assignee: THE GOVERNING COUNCIL OF THE UNIVERSITY OF TORONTO, Toronto (CA)

( * ) Notice: Subject to any disclaimer, the term of this patent is extended or adjusted under 35 U.S.C. 154(b) by 527 days.

(21) Appl. No.: 18/268,723

(22) PCT Filed: Dec. 14, 2021

(86) PCT No.: PCT/CA2021/051799
§ 371 (c)(1),
(2) Date: Jun. 21, 2023

(87) PCT Pub. No.: WO2022/133581
PCT Pub. Date: Jun. 30, 2022

(65) Prior Publication Data

US 2024/0042523 A1 Feb. 8, 2024

(30) Foreign Application Priority Data

Dec. 21, 2020 (CA) ..... CA 3103578

(51) Int. Cl.
*B22F 9/20* (2006.01)
*C22B 1/16* (2006.01)
*C22B 23/02* (2006.01)

(52) U.S. Cl.
CPC ..... *B22F 9/20* (2013.01); *C22B 1/16* (2013.01); *C22B 23/023* (2013.01);
(Continued)

(58) Field of Classification Search
CPC ..... C22B 23/023
(Continued)

(56) References Cited

U.S. PATENT DOCUMENTS 2,668,107 A * 2/1954 James ..... C22B 15/0047 423/47
4,135,913 A 1/1979 Illis et al.

FOREIGN PATENT DOCUMENTS

WO WO-2016171579 A1 * 10/2016 ..... C22B 23/02

OTHER PUBLICATIONS

WO-2016171579-A1 English (Year: 2016).*
International Search report PCT/CA2021/051799 dated Mar. 21, 2022 (pp. 1-4).
(Continued)

*Primary Examiner* — Ricardo D Morales
(74) *Attorney, Agent, or Firm* — Csaba Henter; MILLEN, WHITE, ZELANO & BRANIGAN

(57) ABSTRACT

A thermal two-step process for producing ferronickel (FeNi) alloy particles from a nickel-containing sulfide material is provided. The process comprises heating a solid mixture comprising a nickel-containing sulfide material and an iron-containing material in agglomerated form, in an inert or reducing atmosphere to a heating temperature at which the solid mixture is partially molten and obtaining a hot mixture comprising a nickel-containing liquid phase, gangue, and FeNi alloy particles, and then controlled cooling of the hot mixture to increase the particle size and Ni content of said FeNi alloy particles and obtaining a processed material comprising said FeNi alloy particles having an increased particle size and an increased Ni content. Finally, the FeNi alloy particles are separated from the processed material.
(Continued)

There is also provided FeNi alloy particles obtained from the process.

26 Claims, 12 Drawing Sheets

(52) U.S. Cl.
CPC ..... *B22F 2201/01* (2013.01); *B22F 2301/35* (2013.01); *B22F 2998/10* (2013.01)

(58) Field of Classification Search
USPC ..... 75/351, 352
See application file for complete search history.

(56) References Cited

OTHER PUBLICATIONS

Yu, D. et al.: "Thermal Upgrading of Nickeliferous Pyrrhotite Tailings for the Recovery of Nickel in the Form of Ferronickel Alloy", Metall Mater Trans B, vol. 50, 2019, pp. 2186-2196, XP036896885, DOI: 10.1007/s11663-019-01646-5.
Rezaei S., Liu F., Marcuson S., Muinonen M., Lakshmanan V. L., Sridhar R., Barati M.: "Canadian pyrrhotite treatment: the history, inventory and potential for tailings processing", Canadian Metallurgical Quarterly, vol. 56, No. 4, 2017, pp. 410-417, XP055952415, DOI: 10.1080/00084433.2017.1361671.
Feng Liu et al.: "Thermal upgrading of nickeliferous pyrrhotite tailings: Formation mechanism of ferronickel alloy", Minerals Engineering, vol. 134, 2019, pp. 206-214, XP085618195, ISSN: 0892-6875, DOI: 10.1016/j.mineng.2019.02.006.
Fanmao Wang et al.: "Solid State Extraction of Nickel from Nickel Sulfide Concentrate s", Journal of Alloys and Compound S, vol. 822, 2020, pp. 153582, XP086025672, ISSN: 0925-8388, DOI: 10.1016/j.iallcom.2019.153582.
Sridhar et al: Recovery of nickel from nickeliferous pyrrhotite by a thermal upgrading process, Canadian Metallurgical Quarterly, 15:3, 255-262.
Wang et al: "Solid State Extraction of Nickel from Nickel Sul□de Concentrates" Journal of Alloys and Compounds 822 (2020) 153582 (pp. 1-9).
Wang et al: "Optimum Treatment Time for Solid-State Extraction of Nickel from Nickel Sulfide Concentrates at 1073 K" Metallurgical and Materials Transactions; 2642—vol. 51B, Dec. 2020 (pp. 1-11).
Feng Liu et al., Formation mechanism of the ferronickel alloy due to the reaction between iron and nickeliferous pyrrhotite at 850-900 C—Extraction 2018, The Minerals, Metals & Materials Series, pp. 415-422 https://doi.org/10.1007/978-3-319-95022-8_33.
Feng Liu et al., —Thermal Concentration of Nickeliferous Pyrrhotite Concentrate for Nickel Recovery Using Metallic Iron Thermodynamic Assessments and Effects of Process Variables—JOM, vol. 73, No. 6, 2021; pp. 1928-1936 https://doi.org/10.1007/s11837-021-04689-9-2021.
Fanmao Wang, et al., —Ferronickel Generation from Nickel Sulfide Concentrates by Metallic Iron Addition Optimization of the Nickel Extraction Process—Metallurgical and Materials Transactions B, 3120-3129, vol. 52B, Oct. 2021.
Fanmao Wang, et al., —Nickel Extraction from Nickel Sulfide Concentrates by Iron Addition Ferronickel Formation Mechanism—Metallurgical and Materials Transactions B—3920-3929, vol. 52B, Dec. 2021.
Fanmao Wang, et al., —Preparation of high nickel grade ferronickel from nickel sulfide concentrate with minimual sulfur dioxide emission—Metallurgical and Materials Transactions B—2023, https://doi.org/10.1007/s11663-023-02872-8 (pp. 1-11).
Fanmao Wang, et al., —One-step extraction of nickel from nickel sulfide concentrates by iron addition—The Minerals, Metals & Materials Society 2021; The 5th International Symposium on Nickel and Cobalt, The Minerals, Metals & Materials Series, https://doi.org/10.1007/978-3-030-65647-8_20 (pp. 243-249).
Ertserva et al., —Reducing heat treatment of pyrrhotite concentrate—Tsvetnye Metally, (Russian Journal of Non-Ferrous Metals) vol. 39, No. 1, pp. 20-22, 1998.
Ertserva et al., —Reductive heat treatment of pyrrhotite from a pyrrhotite-containing copper-nickel sulfide raw material—Tsvetnye Metally, (Russian Journal of Non-Ferrous Metals) vol. 38, No. 5, pp. 9-14, 1997.
Ertserva et al.,—Studies of physical and chemical characteristics of thermal concentration of pyrrhotite and chalcopyrite pres—Tsvetnye Metally, (Russian Journal of Non-Ferrous Metals) vol. 40, No. 5, pp. 31-33, 1999.
Ertserva et al.,—Study of physicochemical relations of the process of thermal enrichment—Tsvetnye Metally, (Russian Journal of Non-Ferrous Metals) vol. 39, No. 10, pp. 18-21, 1998.
Wang Fanmao: PhD thesis "Solid-State Extraction of Nickel from Nickel Sulphide Concentrates by Iron Addition" Graduate Department of Materials Science and Engineering—University of Toronto (2021) pp. 1-179.

* cited by examiner

TWO-STEP THERMAL TREATMENT OF NICKEL-CONTAINING SULFIDES FOR THE PRODUCTION OF FERRONICKEL

RELATED APPLICATION

This application claims priority to Canadian patent application No. 3.103.578 filed on Dec. 21, 2020, the content of which is incorporated herein by reference in its entirety for all purposes.

TECHNICAL FIELD

The technical field relates to the treatment of nickel sulfide material such as derived from sulfide ore extraction, and more particularly to the production of ferronickel alloy particles from such nickel sulfide material, using a heating treatment followed by a controlled cooling treatment.

BACKGROUND

Nickel produced from sulfide ores constitutes a significant portion of the world's nickel output. The extraction of nickel from sulfide ores is currently achieved by smelting of concentrate, which involves a two-stage process in which concentrate is melted and reacted with oxygen in the liquid state to remove most of its sulfur and iron, and yield a nickel sulfide melt known as matte. This product is not directly marketable and has to be further refined by a long series of steps which may comprise (a) roasting to remove sulfur, (b) reduction to crude nickel, (c) reaction of impure metallic nickel with CO to produce nickel carbonyl and refined nickel metal or (d) electrowinning of nickel matte or electrorefining of crude nickel metal. In all cases, these refining steps are expensive and add materially to production of a marketable product. In summary, the conventional method of producing a marketable nickel product is a complex, multi-process technology, is expensive, and generates a substantial amount of $SO_2$ gas which is either released to the atmosphere or captured at a cost. The significant cost of $SO_2$ abatement alone has in some instances resulted in the shutdown of smelters.

In extraction of nickel from sulfide ores (containing 1-3% Ni typically), the ore is first upgraded to a Ni-rich stream called concentrate (>10% Ni) leaving behind a large amount of Ni-lean material, known as tailings. The tailings still contain up to 1% Ni but are discarded and stored in tailing ponds for an indefinite time. In the 1970's, a thermal treatment method to extract the Ni content of the tailings was proposed by Sridhar et al. in "*Recovery of nickel from nickeliferous pyrrhotite by a thermal upgrading process*". Can. Metall. Q. 15 (1976) 255-262. However, due to the economics of the process at the time, it was not progressed beyond lab testing. More recently, research was pursued with the objective of optimizing this thermal process and re-assess the economics and technical viability in today's climate (D. Yu et al. "*Thermal Upgrading of Nickeliferous Pyrrhotite Tailings for the Recovery of Nickel in the Form of Ferronickel Alloy*", Metallurgical and Materials Transactions B, 2019 (50) 2186-2196; F. Liu et al. "*Thermal Upgrading of Nickeliferous Pyrrhotite Tailings: Formation Mechanism of Ferronickel Alloy*", Mineral Engineering, 134 (2019) 206-214; S. Rezaei et al. "*Canadian Pyrrhotite Tailings: The History, Inventory and Potential for Tailings Processing*", Canadian Metallurgical Quarterly, 2017 (56) 410-417). Subsequent to that research, the authors attempted to apply the same principle (thermal treatment) to the concentrate, instead of tailings. In this approach, Ni is extracted by adding iron to the concentrate, and heating it to a certain temperature, so that Ni precipitates out of the sulfide matrix as ferronickel (FeNi) particles, which are then separated from the sulfide and recovered as a FeNi concentrate. The heating temperature is high enough to induce migration of nickel to the iron particles but low enough to avoid significant liquefaction of the sulfide phases (F. Wang, F. Liu, R. Elliott, S. Rezaei, L. Tafaghodi Khajavi, M. Barati, "*Solid State Extraction of Nickel from Nickel Sulfide Concentrates*", Journal of Alloys and Compounds, 822 (2020) 153582). However, the size of the FeNi particles obtained by this treatment was too small to be recovered at the end of the process, which could be a roadblock for any commercial technology.

SUMMARY

According to a first aspect, there is provided a process for producing ferronickel (FeNi) alloy particles from a nickel-containing sulfide material, comprising the steps of:

- providing a nickel-containing sulfide material;
- mixing and agglomerating the sulfide material and an iron-containing material to obtain a solid mixture comprising iron and the sulfide-material in agglomerated form;
- heating the solid mixture in an inert or reducing atmosphere to a heating temperature at which the solid mixture is partially molten and obtaining a hot mixture comprising a nickel-containing liquid phase, gangue, and FeNi alloy particles;
- controlled cooling of the hot mixture to increase the particle size and Ni content of said FeNi alloy particles and obtaining a processed material comprising said FeNi alloy particles having an increased particle size and an increased Ni content; and separating the FeNi alloy particles from the processed material.

In one optional embodiment, the nickel-containing sulfide material derives from sulfide ore extraction. In another optional embodiment, the nickel-containing sulfide material derives from a low-grade ultramafic nickel sulfide ore. In another optional embodiment, the nickel-containing sulfide material comprises a Ni sulfide concentrate, Ni-rich matte or a mixture thereof. In another optional embodiment, the nickel-containing sulfide material comprises a Ni-rich matte. In another optional embodiment, the Ni-rich matte comprises a furnace matte or converter matte or a mixture thereof. In another optional embodiment, the nickel-containing sulfide material comprises a Ni sulfide concentrate.

In another optional embodiment, the nickel-containing sulfide material comprises from about 2 wt % to about 65 wt % Ni. In another optional embodiment, the nickel-containing sulfide material comprises from about 5 wt % to about 22 wt % Ni.

In another optional embodiment, the iron-containing material comprises metallic iron or an iron alloy (e.g., steel). In another optional embodiment, the iron-containing material comprises recycled ferronickel-containing middling from the physical separation of ferronickel produced by the process in an earlier treatment. In another optional embodiment, the iron-containing material comprises at least one iron oxide and the iron oxide is mixed with the sulfide material in the presence of a reductant or in a reducing atmosphere. In another optional embodiment, the iron-containing material comprises FeO, $Fe_2O_3$, $Fe_3O_4$ or any mixture thereof. In another optional embodiment, the reductant comprises coal, coke, activated carbon or any mixture thereof. In another optional embodiment, the reducing atmosphere comprises hydrogen, natural gas, CO or any mixture thereof. In another optional embodiment, the iron-containing material is in powder form. In another optional embodiment, the iron-containing material is in the form of particles having a size of from about 5 μm to about 2 mm. In another optional embodiment, the iron-containing material is in the form of particles having a size of from about 5 μm to about 200 μm. In another optional embodiment, the iron-containing material is in the form of particles having a size being comparable to a particle size of the Ni-containing material.

In another optional embodiment, the process further comprises determining the amount of iron-containing material to be mixed with the nickel-containing sulfide material based on the phase relations in the Fe—Ni—S system at the heating temperature to produce the partially molten mixture.

In another optional embodiment, the process further comprises analyzing the nickel-containing sulfide material to find out an iron, nickel and sulfur content thereof and determining the amount of iron-containing material to be mixed with the nickel-containing sulfide material based on the phase relations in the Fe—Ni—S system at the heating temperature to produce the partially molten mixture.

In another optional embodiment, the iron-containing material is mixed with the sulfide material in a ratio of iron or iron equivalent to sulfide material of at least 0.05 on a mass basis. In another optional embodiment, the iron-containing material is mixed with the sulfide material in a ratio of iron or iron equivalent to sulfide material of from 0.05 to about 1.2 on a mass basis. In another optional embodiment, the iron-containing material is mixed with the sulfide material in a ratio of iron or iron equivalent to sulfide material of from about 0.1 to about 1.2 on a mass basis.

In another optional embodiment, agglomerating the sulfide material and an iron-containing material comprises pelletizing or briquetting.

In another optional embodiment, the hot mixture comprises from about 5 wt % to about 70 wt % of the nickel-containing liquid phase. In another optional embodiment, the hot mixture comprises from about 40 wt % to about 60 wt % of the nickel-containing liquid phase.

In another optional embodiment, the gangue in the hot mixture comprises sulfides, such as nickel-depleted iron sulfide.

In another optional embodiment, the gangue in the hot mixture comprises oxides.

In another optional embodiment, after heating and before cooling, the FeNi alloy particles are characterized by a $d_{80}$ by weight of from about 100 μm to about 300 μm.

In another optional embodiment, the heating temperature is from about 750° C. to about 1300° C. In another optional embodiment, the heating temperature is from about 900° C. to about 1300° C. In another optional embodiment, the heating temperature is from about 750° C. to about 1200° C. In another optional embodiment, the heating temperature is from about 950° C. to about 1000° C. In another optional embodiment, heating the solid mixture at the heating temperature is performed for a period of 1 minute or longer. In another optional embodiment, heating the solid mixture is performed in an inert atmosphere. In another optional embodiment, heating the solid mixture is performed in a reducing atmosphere comprising hydrogen, natural gas, carbon monoxide or any mixture thereof.

In another optional embodiment, controlled cooling of the hot mixture comprises cooling at a rate of at most about 10° C./min. In another optional embodiment, cooling of the hot mixture comprises cooling at a rate from about 0.5° C./min to about 10° C./min.

In another optional embodiment, controlled cooling of the hot mixture comprises cooling from the heating temperature to an intermediate cooling temperature, and then cooling from the intermediate temperature to room temperature. In another optional embodiment, the intermediate cooling temperature is in the range from about 500° C. to about 800° C. In another optional embodiment, the intermediate cooling temperature is in the range from about 500° C. to about 750° C. In another optional embodiment, the intermediate cooling temperature is in the range from about 600 to about 800° C. In another optional embodiment, cooling from the heating temperature to the intermediate cooling temperature is performed at a rate of at most about 10° C./min. In another optional embodiment, cooling from the heating temperature to the intermediate cooling temperature is performed at a rate from about 0.5° C./min to about 10° C./min. In another optional embodiment, the mixture is maintained at the intermediate temperature for a period of time. In another optional embodiment, the period of time ranges from about 10 min to about 4 days. In another optional embodiment, the period of time ranges from about 10 min to about 5 hours.

In another optional embodiment, controlled cooling of the hot mixture is performed in an inert atmosphere. In another optional embodiment, controlled cooling of the hot mixture is performed in a reducing atmosphere (e.g., natural gas, CO and/or hydrogen).

In another optional embodiment, the particle size of the FeNi alloy particles after cooling, expressed as $d_{80}$ by weight, increases by about 10% to about 200% compared to the particle size of the FeNi alloy particles, expressed as $d_{80}$ by weight, before cooling.

In another optional embodiment, separating the FeNi alloy particles comprises grinding the processed material followed by magnetic separation, gravity separation and/or sieving.

In another optional embodiment, at least about 30% of the Ni present in the nickel-containing sulfide material is recovered in the separated FeNi alloy particles. In another optional embodiment, at least about 50% of the Ni present in the nickel-containing sulfide material is recovered in the separated FeNi alloy particles. In another optional embodiment, at least about 90% of the Ni present in the nickel-containing sulfide material is recovered in the separated FeNi alloy particles.

In another optional embodiment, the separated FeNi alloy particles comprise from about 5 wt % to about 63 wt % Ni. In another optional embodiment, the separated FeNi alloy particles comprise from about 10 wt % to about 50 wt % Ni. In another optional embodiment, the separated FeNi alloy particles comprise from about 10 wt % to about 40 wt % Ni. In another optional embodiment, the separated FeNi alloy particles comprise from about 50 wt % to about 60 wt % Ni.

In another optional embodiment, the separated FeNi alloy particles are characterized by a particle size $d_{80}$ by weight of at least about 200 μm.

In another optional embodiment, the process is substantially $SO_2$ emission-free.

In another optional embodiment, a sulfur lost from the Ni-containing sulfide material is below about 10 wt %.

According to another aspect, there is provided ferronickel alloy particles obtained by the process as herein defined.

Other objects, advantages and features of the present description will become more apparent upon reading of the following non-restrictive description of specific embodiments thereof, given by way of example only with reference to the accompanying drawings.

DETAILED DESCRIPTION

General Definitions

Figure 1:
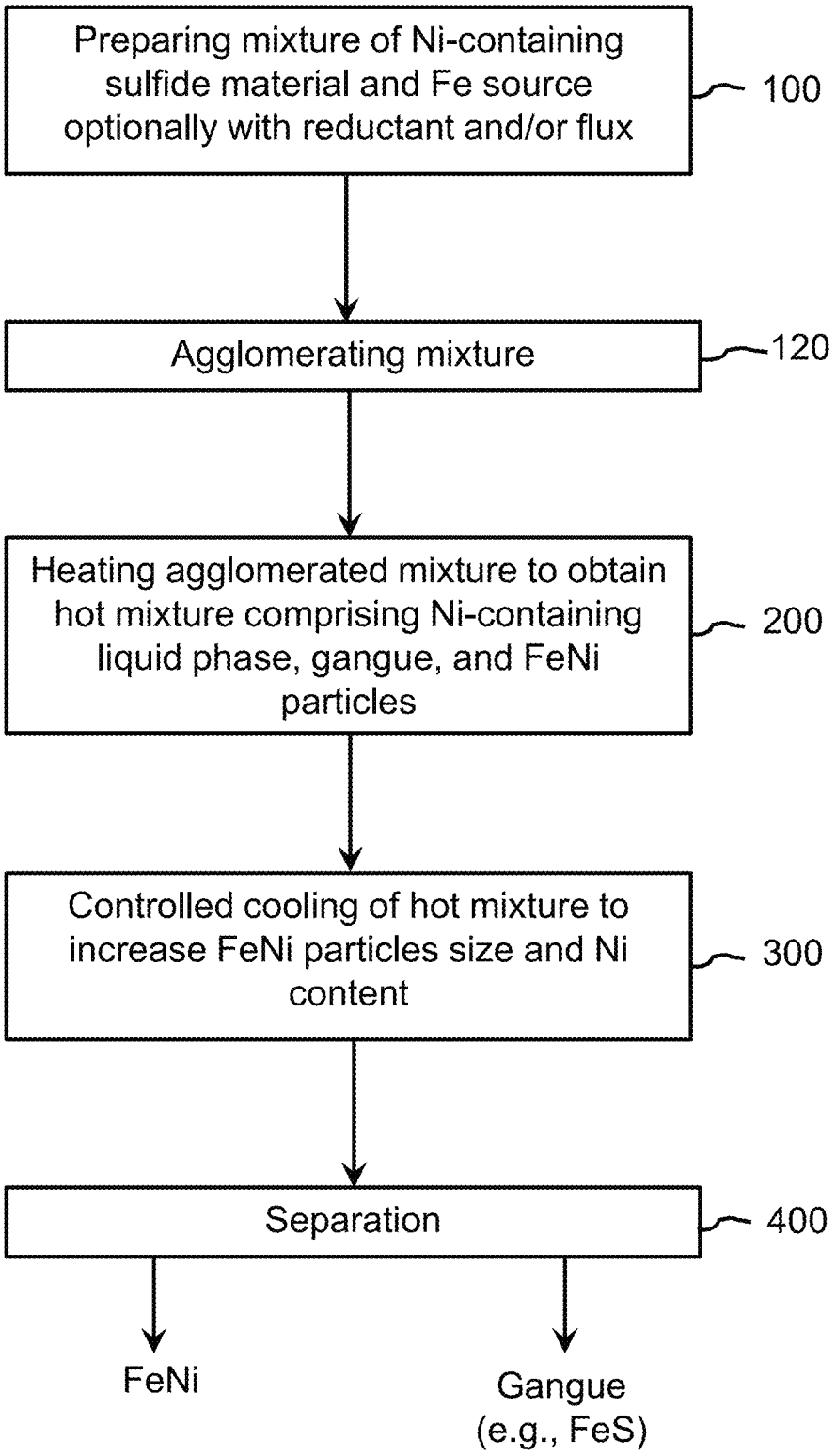
FIG. 1 is block diagram presenting the main steps of the process according to one embodiment.

The use of the word "a" or "an" when used in conjunction with the term "comprising" in the claims and/or the specification may mean "one" but it is also consistent with the meaning of "one or more", "at least one", and "one or more than one".

The term "about" is used to indicate that a value includes the standard deviation of error for the device or method being employed in order to determine the value. In general, the terminology "about" is meant to designate a possible variation of up to 10%. Therefore, a variation of 1, 2, 3, 4, 5, 6, 7, 8, 9 and 10% of a value is included in the term "about". Unless indicated otherwise, use of the term "about" before a range applies to both ends of the range.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

DESCRIPTION OF EMBODIMENTS

The present disclosure thus relates to a process for the treatment of a nickel-containing sulfide material, and more particularly to the production of ferronickel (FeNi) alloy particles from such nickel sulfide material, using a thermal treatment followed by a controlled cooling treatment. The process generally involves adding iron to the nickel-containing sulfide material, agglomerating the resulting mixture and heating the agglomerated mixture to obtain a hot mixture comprising a nickel-containing liquid phase, gangue, and FeNi alloy particles and then controlled cooling of the hot mixture. The controlled cooling results in an increase of the particle size and Ni content of the FeNi alloy particles. Each step of the process will be described in more detail below, with reference to the Figures. In the following description, the expressions "ferronickel alloy particles", "ferronickel particles", "ferronickel", "FeNi alloy particles", "FeNi particles" and "FeNi" are used interchangeably and mean a material in particulate and alloy form comprising nickel and iron.

As mentioned above, the process involves the treatment of a nickel-containing sulfide material as starting material to produce the FeNi alloy particles. The expression "nickel-containing sulfide material", as used herein, refers to a material containing at least nickel and sulfur that is generally derived from sulfide ore extraction. The nickel-containing sulfide material can also include other metals and particularly iron. In some embodiments, the nickel-containing sulfide material can comprise a Ni sulfide concentrate, Ni-rich matte or a mixture thereof. However, the nickel-containing sulfide material is not limited to these materials and could be derived from other nickel-containing sources. Moreover, the nickel-containing sulfide material could also be a nickel-containing sulfide ore itself. Ni sulfide concentrates can be obtained through upgrading the extracted sulfide ores and can be referred to as a "Ni-rich" material containing at least about 10 wt % Ni. A Ni-rich sulfide concentrate can thus have a Ni content of about 10 wt % to about 22 wt %, for instance about 10 wt %, about 11 wt %, about 12 wt %, about 13 wt %, about 14 wt %, about 15 wt %, about 16 wt %, about 17 wt %, about 18 wt %, about 19 wt %, about 20 wt %, about 21 wt %, about 22 wt %, or any decimal value between these percentages. In other embodiments, the Ni sulfide concentrate can be a low nickel grade sulfide concentrate with a Ni content of less than about 10 wt %. As mentioned above, the nickel-containing material can also include sulfide ores, which generally have a Ni content from about 1 wt % to about 4 wt %, e.g., about 2 wt % to about 3 wt %. Hence, in some embodiments, the nickel-containing material being an ore or a low-grade nickel concentrate can have a Ni content of about 1 wt %, about 2 wt %, about 3 wt %, about 4 wt %, about 5 wt %, about 6 wt %, about 7 wt %, about 8 wt %, about 9 wt %, and less than about 10 wt %, or any decimal value between these percentages. The Ni-rich matte can be derived from a Ni sulfide concentrate itself. More particularly, the concentrate can be melted and reacted with oxygen in the liquid state to remove most of its sulfur and iron, to yield a Ni-rich matte. Hence, the Ni-rich matte can have a Ni content that is higher than the Ni content of a Ni sulfide concentrate. In some embodiments, the Ni-rich matte can be used as the nickel-containing material, in liquid state or in solid state. In other embodiments, the Ni-rich matte can comprise a furnace matte, i.e., a matte resulting from primary smelting furnace, or a converter matte, i.e., a matte resulting from converting molten primary smelting furnace matte in a converter. In some embodiments, the Ni-rich matte can have a Ni content of up to about 65 wt %. For example, the Ni-rich matte can have a Ni content of from about 10 wt % to about 65 wt %. The Ni-rich matte can have a Ni content of about 10 wt %, 15 wt %, 20 wt %, 25 wt %, 30 wt %, 35 wt %, 40 wt %, 45 wt %, wt %, 55 wt %, 60 wt %, 65 wt %, or any value between these percentages. One will understand that the content in nickel of the nickel-containing sulfide material, which is used in the present process, can depend on different factors including the origin of the sulfide ore itself but also the conditions at which the ore is treated and upgraded. In some embodiments, the nickel-containing sulfide material can thus comprise from about 2 wt % to about 65 wt % Ni. In another embodiment, the nickel-containing sulfide material can comprise from about 5 wt % to about 22 wt % Ni.

The nickel-containing sulfide material used in the process can thus be a sulfide ore or be derived from a sulfide ore upgrading operation, as explained above. If in some embodiments the nickel-containing sulfide material can preferably comprise a Ni sulfide concentrate or a Ni-rich matte, other material resulting from the upgrading operation can however be used. For instance, in some embodiments, the nickel-containing sulfide material can include tailings resulting from the sulfide ore upgrading operation. In some embodiments, the tailings can be concentrated to reach a minimum Ni concentration (e.g., about 2 wt %) and provide a product that can be used as the nickel-containing sulfide material in the present process.

In a particular embodiment, the nickel-containing sulfide material can include a concentrate produced from low-grade ultramafic nickel sulfide deposits in which the high content of serpentine and other magnesium silicates often precludes commercial exploitation. Indeed, upon extraction/upgrading of such low-grade ultramafic nickel sulfide, the naturally floatable MgO-containing mineral is recovered along with the Ni-containing sulfide minerals and reported to concentrates. However, smelting of these concentrates creates excessive amounts of high melting point viscous slags, limiting their industrial application. As will be explained in detail below, the present process does not involve smelting of the nickel sulfide material and, therefore, applying the process to a concentrate derived from low-grade ultramafic nickel sulfide would not produce slag, lifting the limitation observed using conventional smelting processes.

In some embodiments, the nickel-containing sulfide material can comprise a particulate material with particles having a size of from about 1 μm to about 4 mm. In preferred embodiments, the particle size of the nickel-containing sulfide material can be about 5 μm to about 2 mm, about 5 μm to about 1 mm, about 5 μm to about 500 μm, about 5 μm to about 400 μm, about 5 μm to about 300 μm, about 5 μm to about 200 μm, or about 5 μm to about 200 μm. Hence, the nickel-containing sulfide material can comprise particles with a particle size having any value in between these ranges. When defining the particle size, and unless specifically mentioned otherwise, one generally refers to the particle size distribution. Hence, particles of different sizes can be present in the material while having a size within the defined ranges. It may also be possible that the material comprises, to some extent, particles having lower or higher sizes than defined by the value ranges.

The different steps of the present process will now be discussed with reference to FIGS. 1 and 2. The first step 100 of the process comprises the preparation of a mixture of the Ni-containing sulfide material and an iron-containing material, also referred to as "iron source" in the present description. The resulting mixture is then agglomerated in step 120 to form an agglomerated solid mixture, which is then subjected to a heating step 200 to obtain a hot mixture comprising a Ni-containing liquid phase, gangue, and FeNi particles. In the next step 300, the hot mixture is subjected to a controlled cooling which can allow increasing the size and Ni content of the FeNi particles. Then, the FeNi particles can be separated and recovered in step 400. Each step will now be described in more detail below.

In the first step 100, the Ni-containing material is thus mixed with the iron source to form a solid mixture that will then be subjected to two thermal treatments to produce the final desired FeNi alloy particles. Various iron sources can be used in the process as far as they allow obtaining a solid mixture with the Ni-containing material wherein iron is in metallic form. In some embodiments, the iron source can thus be metallic iron (Fe) or an iron alloy, such as steel for instance. However, other iron sources can be used such as iron oxides. When an iron oxide is used as the iron source, the iron oxide is mixed with the Ni-containing sulfide material in the presence of a reductant or in a reducing atmosphere, to allow the formation of metallic iron "in situ". Examples of iron oxides that can be used as the iron source to prepare the solid mixture that will be subjected to the thermal treatment in the next step of the process, can include FeO, $Fe_2O_3$, $Fe_3O_4$ or any mixture thereof. Any type of reductant capable of reducing iron oxides can be used to form metallic iron in situ. For instance, the reductant can comprise coal, coke, activated carbon or any mixture thereof. Instead of using a solid reductant material, in situ formation of metallic iron can involve mixing the iron oxide with the Ni-containing sulfide material under a reducing atmosphere. In some embodiments, the reducing atmosphere can comprise a reducing gas such as hydrogen, natural gas, CO or any mixture thereof.

In some embodiments, the iron-containing material is mixed with the Ni-containing sulfide material in powder form. In other embodiments, the iron-containing material can be in the form of particles having a size of from about 1 μm to about 4 mm. In preferred embodiments, the particle size of the iron-containing material can be between about 5 μm to about 2 mm, between about 5 μm to about 1 mm, between about 5 μm to about 500 μm, between about 5 μm to about 400 μm, between about 5 μm to about 300 μm, between about 5 μm to about 200 μm, or between about 30 μm to about 200 μm. Hence, the iron-containing material can comprise particles with a particle size having any value in between these ranges. When defining the particle size, and unless specifically mentioned otherwise, one generally refers to the particle size distribution. Hence, particles of different sizes can be present in the material while having a size within the defined ranges. It may also be possible that the material comprises, to some extent, particles having lower or higher sizes than defined by the value ranges.

In some embodiments, the particle size of the iron-containing material can be selected so as to provide desired contact with the Ni-containing sulfide material particles and thereby promote the formation of the liquid phase in the heating step 200.

In some embodiments, it can be advantageous to use an iron-containing material with particles having a size being comparable to the particle size of the Ni-containing material. In another embodiment, one can use an iron-containing material with particles having a size being comparable to the particle size of the Ni-containing material and within a range of from about 5 μm to about 200 μm.

In some embodiments, the amount of iron-containing material to be mixed with the Ni-containing sulfide material in step 100, can be determined in advance of the mixing, based on the phase relations in the Fe—Ni—S system at the temperature envisioned for the heating step 200 to allow obtaining a hot mixture comprising a Ni-containing liquid phase and FeNi alloy particles.

In another embodiment, if the metal content of the Ni-containing sulfide material is not already known, one can analyze the Ni-containing sulfide material to find out at least the iron, nickel and sulfur content thereof before determining the amount of iron-containing material to be used in the mixing step 100. Then, the amount of iron-containing material can be determined based on the phase relations in the Fe—Ni—S system at the temperature envisioned for the heating step 200 to allow obtaining a hot mixture comprising a Ni-containing liquid phase and FeNi alloy particles.

The determination of the amount of iron-containing material to be used in step 100, by referring to the phase relations in the Fe—Ni—S system, is well known in the field. However, an example of such determination is provided in the Example section below.

In some embodiments, the amount of iron-containing material that is mixed with the sulfide material can be expressed as a mass ratio "m" of iron or iron equivalent (e.g., when an iron oxide is used) to Ni-containing sulfide material. In some embodiments, m can be at least 0.05 on a mass basis. In other embodiments, m can be from 0.05 to about 1.2 on a mass basis, from about 0.1 to about 1.2 on a mass basis, or from about 0.2 to about 1.2 on a mass basis. In other embodiments, m can be from 0.05 to about 1.1 on a mass basis, from about 0.1 to about 1.1 on a mass basis, or from about 0.2 to about 1.1 on a mass basis. In other embodiments, m can be from 0.05 to about 1.0 on a mass basis, from about 0.1 to about 1.0 on a mass basis, or from about 0.2 to about 1.0 on a mass basis. In other embodiments, m can be from 0.05 to about 0.9 on a mass basis, from about 0.1 to about 0.9 on a mass basis, or from about 0.2 to about 0.9 on a mass basis. In other embodiments, m can be any value within these mentioned ranges. In other embodiments, m can be 0.05, 0.1, 0.15, 0.20, 0.25, 0.30, 0.35, 0.40, 0.45, 0.50, 0.55, 0.60, 0.65, 0.70, 0.75, 0.80, 0.85, 0.90, 0.95, 1.0, 1.05, 1.1, 1.15, or 1.2 on a mass basis.

The mixing of the Ni-containing sulfide material and iron-containing material can be performed using any conventional mixing device such as drum and/or disk blenders. In one embodiment, if the iron source includes metallic iron particles, the mixing equipment can be designed to limit segregation of the iron and sulfide particles due to differences in specific gravity.

In some embodiments, the mixing of the Ni-containing sulfide material and iron-containing material can be performed in the presence of further additives, which can improve the process. For instance, fluxes including oxides such as lime or sodium oxide can be further added to the mixture of the Ni-containing sulfide material and iron-containing material. Such additives can act as sulfur absorber to improve the release of nickel from the sulfide mineral. In another embodiment, sulfide minerals such as pyrrhotite may be added to the Ni-containing sulfide material and iron-containing material to facilitate Ni extraction and particle growth. Such additives can facilitate the contact between nickel- and iron-bearing particles thus improving the diffusion and growth processes.

In some embodiments, the mixture comprising the iron and Ni-containing materials, and the optional further additives, is thus agglomerated in step 120 resulting in a mixture of iron and sulfide-material in agglomerated form. This agglomeration step can be important to improve the contact between the iron source and the sulfide mineral which in turn improves extraction of nickel into FeNi particles. In some embodiments, agglomeration can be performed by pelletizing or briquetting the mixture of iron and Ni-containing materials, and the optional additives, producing an agglomerated mixture of iron and sulfide-material which is in the form of pellets or briquettes. In some embodiments, mixing and agglomerating can be performed in the same equipment. For instance, to obtain pellets, one can place the iron source, Ni-containing sulfide material and optional additives in a rotary drum agglomerator or a disc pelletizer (pan granulator). In some embodiments, briquettes can be obtained by compaction of a mixture comprising the iron source, Ni-containing sulfide material and optional additives.

Figure 2:
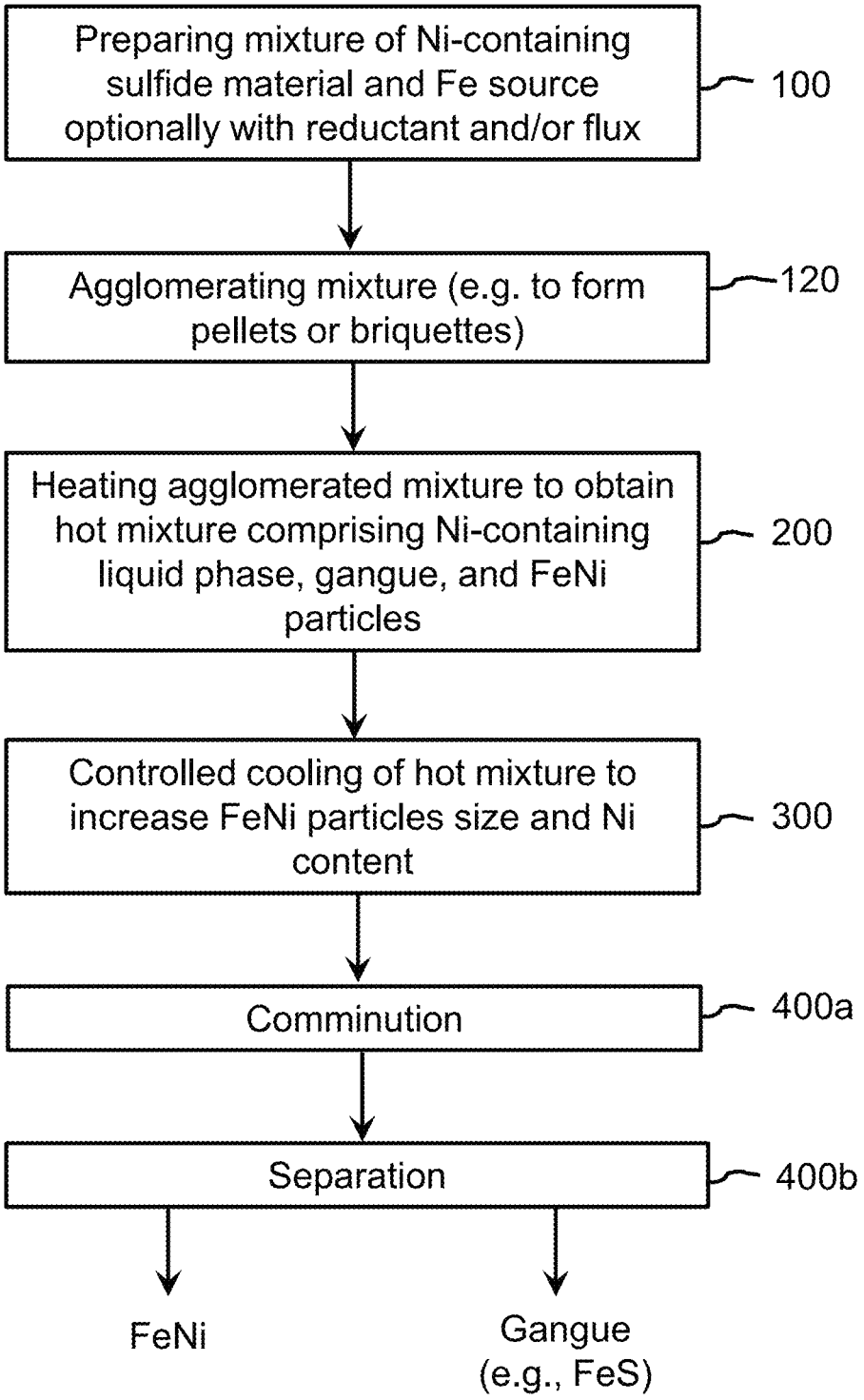
FIG. 2 is block diagram presenting the process steps according to another embodiment.

In the next step 200 of the process, the agglomerated mixture comprising the Ni-containing sulfide material and iron is subjected to heating as shown in FIGS. 1 and 2. The process step 200 can thus involve heating the mixture comprising the Ni-containing sulfide material and iron, in agglomerated form, to a selected heating temperature at which the solid mixture becomes partially molten but not fully liquefied. The selected heating temperature should be low enough to avoid smelting of the agglomerated mixture, i.e., avoid full liquefaction of the sulfide phase.

The heating step 200 thus allows obtaining a hot mixture comprising a Ni-containing liquid phase, gangue, and FeNi alloy particles. As understood in the field, gangue comprises undesired part which can be present in the product, namely anything but FeNi. In some embodiments, gangue can include sulfides, such as nickel-depleted iron sulfide, and/or non-sulfide constituents, such as oxides. The nature of the gangue can vary depending on the ore from which the nickel-containing sulfide material derives. The selection of a heating temperature at which the mixture of iron and Ni-containing sulfide material can be partially molten is believed to be important as it has been observed that the FeNi particles can grew faster in the presence of liquid as compared to that in a solid state. It has been observed that the presence of even small amounts of liquid sulfide can facilitate the Ni and Fe diffusion and promote the FeNi particles grow to a significant size.

In some embodiments, the heating step can be performed in an inert atmosphere. In other embodiments, the heating step can be performed in a reducing atmosphere, which can for example comprise hydrogen, natural gas, carbon monoxide or any mixture thereof. The heating can be performed in any conventional furnace such as rotary kiln or rotary hearth furnace or stationary kiln with a moving grate.

In some embodiments, the temperature at which the mixture of iron and Ni-containing sulfide is heated is below the smelting temperature of the mixture. In some embodiments, the heating temperature can range from about 700° C. to about 1300° C. or from about 750° C. to about 1300° C. In another embodiment, more applicable to high-melting point ores, the heating temperature can range from about 900° C. to about 1300° C. In other embodiments, the heating temperature can range from about from about 750° C. to about 1200° C., or from about 750° C. to about 1150° C., or from about 750° C. to about 1100° C., or from about 750° C. to about 1050° C. In further embodiments, the heating temperature can range from about 950° C. to about 1000° C. The temperature at which the mixture of iron and Ni-containing sulfide is heated can also range from about 800° C. to about 1000° C., or from about 850° C. to about 1000° C., or from about 900° C. to about 1000° C. The heating temperature can thus be any temperature comprised in these value ranges as long as it is low enough to avoid smelting of the agglomerated mixture, as explained above.

Since the kinetics of FeNi precipitation are fast, the heating step 200 does not need to be long. In some embodiments, heating can be performed for a period of 1 minute or longer. In an example, heating can be performed for a period from about 1 minute to about 60 minutes. In other embodiments, the heating can be performed for a period of from about 10 to about 60 minutes, or from about 10 to about 50 minutes, or from 10 to about 40 minutes, or from about 10 to about 30 minutes. The duration can be adjusted depending on the heating temperature as long as a liquid phase is created upon heating to promote the FeNi particles growth.

In some embodiments, the heating step 200 can allow the formation of a hot mixture comprising from about 5 wt % to about 70 wt % of the nickel-containing liquid phase. In other embodiments, the nickel-containing liquid phase can represent from about 10 wt % to about 70 wt %, or from about 20 wt % to about 70 wt %, or from about wt % to about 70 wt %, or from about 40 wt % to about 70 wt %, or from about 40 wt % to about 60 wt % of the hot mixture resulting from the heating step. The weight percentage of the liquid phase in the hot mixture can thus be any value comprised in these value ranges.

The size of the FeNi alloy particles at the end of the heating step 200 can vary depending on the size of the initial iron particles that are used for preparing the mixture with the Ni-containing sulfide material and the selected heating temperature. As mentioned above, the presence of the liquid phase upon heating, can promote the growth of the particle size. In some embodiments, the FeNi alloy particles that are produced by the heating step 200 can have a particle size expressed as a $d_{80}$ by weight ranging from about 100 μm to about 300 μm.

Once the heating is completed, the resulting hot mixture can be subjected to a controlled cooling step 300. The controlled cooling step is important to allow increasing the particle size of the FeNi alloy particles that were formed during the heating step. By "controlled cooling", one means that the cooling step is performed under certain conditions that can facilitate the growth of the FeNi particles and/or increasing their Ni content to desired levels. In some embodiments, the controlled cooling can comprise decreasing the temperature of the hot mixture in a controlled manner. The decrease in temperature of the hot mixture is thus regulated, as opposed to a "direct" cooling or quenching where the hot mixture is placed in a significantly colder environment (e.g., room temperature) immediately after completing the heating step. During the controlled cooling treatment, nickel can preferentially report to the FeNi particles of sufficient size thereby forming larger FeNi particles, which can be more easily separated at the end of the cooling treatment. In addition to increasing the FeNi particle size, the cooling treatment further allows increasing the Ni content of the FeNi particles, which in turn can rise the overall Ni recovery.

Different protocols can be used for the controlled cooling step 300. In some embodiments, the cooling rate can be controlled such that the temperature of the hot mixture can slowly decrease until reaching a lower temperature. In other embodiments, the hot mixture can be cooled to a lower temperature than the heating temperature, with or without controlling the cooling rate, and then maintained at this lower temperature for a certain period. In some embodiments, one can combine different cooling protocols to reach a desired FeNi particle size and/or Ni recovery.

In one embodiment, the controlled cooling can be performed by cooling the hot mixture at a rate sufficient to allow further growth of FeNi particles and increased recovery of Ni into the alloy phase. In some embodiments, cooling the hot mixture can be performed at a rate of at most about 10° C./min. In some embodiments, the cooling rate can range from about 0.5° C./min to about 10° C./min. In some embodiments, the controlled cooling of the hot mixture can be performed at a rate of at most about 9° C./min, or at most about 8° C./min, or at most about 7° C./min, or at most about 6° C./min, or at most about 5° C./min, or at most about 4° C./min, or at most about 3° C./min. In some embodiments, the cooling rate of the hot mixture can range from about 0.5° C./min to about 9° C./min, or from about 0.5° C./min to about 8° C./min, or from about 0.5° C./min to about 7° C./min, or from about 0.5° C./min to about 6° C./min, or from about 0.5° C./min to about 5° C./min, or from about 0.5° C./min to about 4° C./min, or from about 0.5° C./min to about 3° C./min. In other embodiments, the controlled cooling can be performed by cooling the hot mixture from the heating temperature to an intermediate cooling temperature, and then cooling from the intermediate temperature to room temperature. In some embodiments, the intermediate cooling temperature can range from about 500° C. to about 800° C. In other embodiments, the intermediate cooling temperature can range from about 500° C. to about 750° C., or from about 600 to about 800° C., or from 600 to about 750° C. The intermediate cooling temperature can thus be any temperature comprised in these ranges. Furthermore, in some embodiments, cooling from the heating temperature to the intermediate cooling temperature can be performed at a low rate. For instance, the cooling rate used to reach the intermediate cooling temperature can be at most about 10° C./min. In some embodiments, the cooling rate to reach the intermediate cooling temperature can range from about 0.5° C./min to about 10° C./min. In some embodiments, after reaching the intermediate cooling temperature, the mixture comprising the FeNi particles can be maintained at the intermediate temperature for a certain period. During this period, the particle size of the FeNi particle can be further increased. In some embodiments, the mixture can be maintained at the intermediate temperature for a period ranging from about 10 min to about 4 days. However, short periods can be sufficient to reach a suitable particle size. Hence, in some embodiments, the mixture can be maintained at the intermediate cooling temperature for a period of less than about 5 hours, e.g., from about 10 min to about 5 hours. The cooling step can be performed in an inert atmosphere. In other embodiments, the cooling step can be performed in a reducing atmosphere (e.g., natural gas, CO and/or hydrogen).

In some embodiments, the cooling step can take place at a cold end of the furnace that is used for the heating step. However, in other embodiments, the cooling can be performed in a separate cooling unit depending on the choice of furnace and design.

At the issue of the cooling step, the particle size of the FeNi alloy particles, expressed as $d_{80}$ by weight, can be increased by about 10% to about 200% compared to the particle size of the FeNi alloy particles, expressed as $d_{80}$ by weight, before cooling. In some embodiments, the increase can be from about 10% to about 100%, based on the $d_{80}$ by weight particle size. For instance, the $d_{80}$ by weight particle size can be about 200 μm at the end of the heating step and reach a $d_{80}$ by weight particle size of about 220 μm after cooling, representing a 10% increase. It is understood that not all the FeNi particles grow to the same level during the cooling step, but the average increase for about 80 wt % of the particles can be in the above-mentioned ranges. As previously mentioned, the size of the FeNi particles reached at the end of the cooling step allows an easier separation thereof in the next step 400 of the process, which will now be described.

The processed material obtained at the end of the cooling step 300, comprises the FeNi alloy and other by-products (gangue) including iron sulfide (FeS) and optionally oxides. Hence, the sulfur, which was present in the original sulfide material, can be recovered in solid form, bound to iron, in the cooled product. This results in less sulfur release in the atmosphere, i.e., in the form of $SO_2$ gas, which is beneficial for the environment.

In some embodiments, the FeNi alloy material resulting from the cooling step 300 can be separated from the by-products including at least iron sulfide (FeS), using a simple physical separation. In some embodiments, the separation and recovery of the FeNi alloy particles can first involve a comminuting (e.g., grinding) step 400*a* where the cooled material is reduced in size to approximately the size of the FeNi particles. A conventional grinding machines can be used for this comminution step, such as a ball mill, tower mill, or rod mill. After liberation, the FeNi alloy particles can be further separated in step 400*b* by a conventional physical technique such as magnetic separation, gravity separation and/or sieving.

Overall, the present process can allow recovering at least about 30% of the Ni initially present in the Ni-containing sulfide material, as separated FeNi alloy particles. In some embodiments, at least about 50% of the Ni present in the Ni-containing sulfide material can be recovered in the separated FeNi alloy particles. In certain embodiments, it is possible to recover at least about 90% of the initial Ni in the separated FeNi alloy particles. The content in Ni, also referred to as "Ni grade", in the FeNi alloy particles that are obtained at the end of the process can vary depending on the Ni content in the original sulfide material and the amount of iron source added in the first step of the process. In some embodiments, the separated FeNi alloy particles can comprise from about 5 wt % to about 63 wt % Ni. In other embodiments, the separated FeNi alloy particles can comprise from about 5 wt % to about 60 wt % Ni, or from about 10 wt % to about 60 wt % Ni, or from about 10 wt % to about 50 wt % Ni, or from about 10 wt % to about 40 wt % Ni, or from about wt % to about 60 wt % Ni, or from about 30 wt % to about 60 wt % Ni, or from about 40 wt % to about 60 wt % Ni, or from about 50 wt % to about 60 wt % Ni. The Ni content of the separated FeNi alloy can thus be any weight percentage comprises in these ranges.

Regarding the particle size of the separated FeNi alloy, it can also vary but can substantially correspond to the size of the FeNi particles resulting from the cooling step. Indeed, as mentioned above, the FeNi alloy can be liberated through grinding the cooled material obtained at the end of the cooling step to the size of the FeNi particles in this material. In some embodiments, the separated FeNi alloy particles can have a $d_{80}$ by weight particle size of at least about 200 μm.

The FeNi alloy particles obtained by the present process may be directly used in industrial processes requiring nickel and iron intake. In some embodiments, if the impurity levels of the FeNi alloy particles resulting from the process, such as sulfur, are not low enough for certain industrial applications, an additional purification step can be implemented. Purification can be performed according to conventional methods, such as melting and slag treatment, melting and oxygen injection, or comminution followed by flotation, to name of a few examples.

In some embodiments, the FeNi alloy particles resulting from the present process, which may be refined to reduce the impurity levels if required, may be used as feedstock in the manufacture of stainless steels. The FeNi alloy resulting from the present process can have various nickel and iron ratios. The process can allow, to a certain extent, tailoring these ratios by selecting the Ni-containing sulfide material, the heating temperature, and the amount of iron source to be added in the first step of the process. In some embodiments, the FeNi alloy particles obtained by the present process can have Ni content as high as about 50-60% while the current marketable FeNi contains about 5-40 wt % Ni. Hence, the present process can allow obtaining FeNi alloy with Ni grades that have not been obtained before. Such high Ni grade can particularly be obtained by treating certain Ni-containing sulfide material such as Ni-rich matte.

The present process for nickel extraction from sulfide ores, can present several advantages. It allows lowering $SO_2$ emissions and sulfur release compared to conventional processes as substantially all the sulfur remains in solid form, bound to iron. In some embodiments, the sulfur lost based on the initial Ni sulfide material can be below about 10 wt %. In some embodiments, the present process can be substantially $SO_2$ free, at least when applied to Ni concentrates. The present process can thus produce FeNi alloy while retaining the sulfur in the solid iron sulfide by-products, which mitigates the potential $SO_2$ emissions. In addition, the process can be carried out at much lower temperature than the current smelting, resulting in an easier process control and lower capital cost. Surprisingly, this two-stage process can operate quite rapidly while obtaining high Ni recoveries and FeNi particles with a size that is large enough for an easy separation. The present process can thus produce ferronickel alloys at lower costs than the current smelting, which can be directly used to make stainless steels. The production of nickel to a marketable product can take place using the present process, which is considerably simpler than known processes. At commercial scale, the present process can provide significant environmental and economic benefits.

EXAMPLES

Example 1: Determination of the Fe Amount to be Mixed with the Ni-Containing Sulfide Material In this example, the composition of the nickel-containing sulfide material is as follows: % Ni=18.8, % Fe=30.1 and % S=29.9 (percentages in weight of the material).

Figure 3:
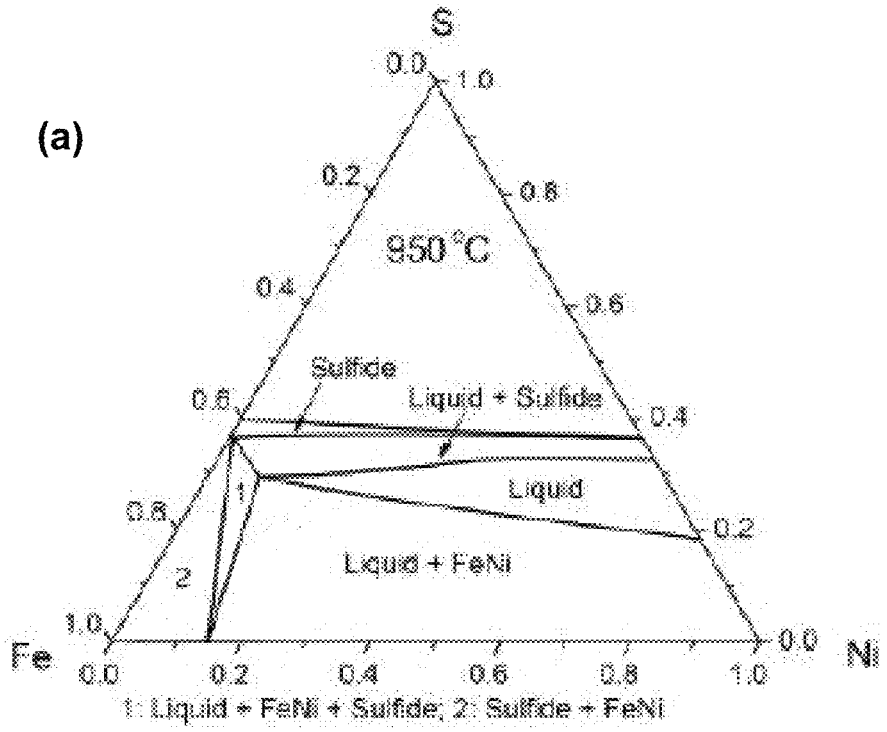
FIG. 3 shows (a) the Fe—Ni—S phase diagram at 950° C. and (b) the Fe—Ni—S phase diagram at 800° C. The Fe—Ni—S phase diagrams were calculated by FactStage™ 6.4.
Figure 3:
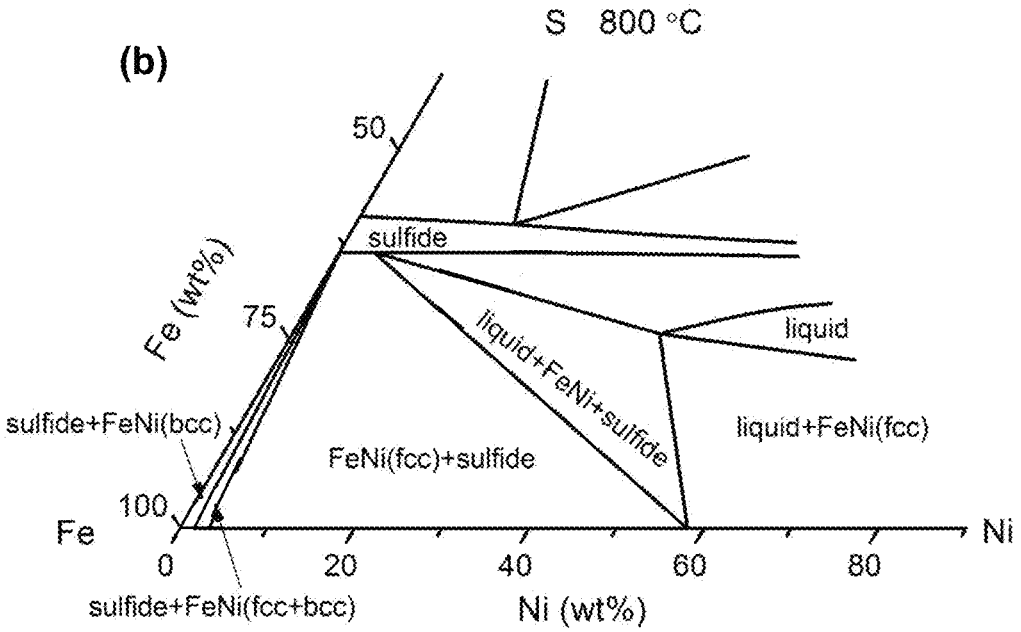

Firstly, select a heating temperature and use the Fe—Ni—S phase diagram at this temperature. As an illustration, the Fe—Ni—S phase diagrams at 800° C. and 950° C. are reported in FIG. 3. For the present example, the selected heating temperature was 800° C. Select 100 weight units of nickel-containing sulfide (18.8 units Ni, 30.1 units Fe, and 29.9 units S) and add from 1 weight unit to 500 weight units Fe.

Secondly, calculate the overall composition of the mixture and find the corresponding composition on the phase diagram and the phase assemblage at each iron increment.

Thirdly, when FeNi is a stable phase in the products, use tie-lines to calculate the composition of the FeNi. This gives the grade of Ni in the FeNi.

Fourthly, use mass balance of iron and nickel to calculate Ni recovery into the FeNi.

Fifthly, select the iron amount addition based on the desired Ni grade and recovery.

Here, targeting a recovery of at least 90% and Ni grade above 10 wt %, the calculations show that adding 40-120 weight units of Fe allows recovering 92-98% of nickel into ferronickel alloy with 16-44 wt % nickel grade.

Thermal treatment tests were performed and validated the calculations by showing 91-97% recovery and 16-49 wt % Ni grade, as determined by analysis of the phases in the product and mass balance. The thermal treatment tests were performed with the following mixtures:

Mixture 1: 3.4 g metallic Fe; 8.6 g Ni concentrate;

Mixture 2: 4 g metallic Fe; 8 g Ni concentrate;

Mixture 3: 5.3 g metallic Fe; 6.7 g Ni concentrate;

Mixture 4: 12 g metallic Fe; 10 g Ni concentrate.

In the four mixtures, metallic Fe powder was mixed with a Ni concentrate having the following composition: Ni=18.8 wt %, % Fe=30.1 wt % and % S=29.9 wt %. The mixture was pressed into 16 mm D×12 mm H briquettes which were isothermally heated at 800° C. under argon atmosphere for 30 min.

Example 2: Two-Step Thermal Treatment According to the Present Process and Comparison with One-Step Process without Controlled Cooling

Material

Figure 4:
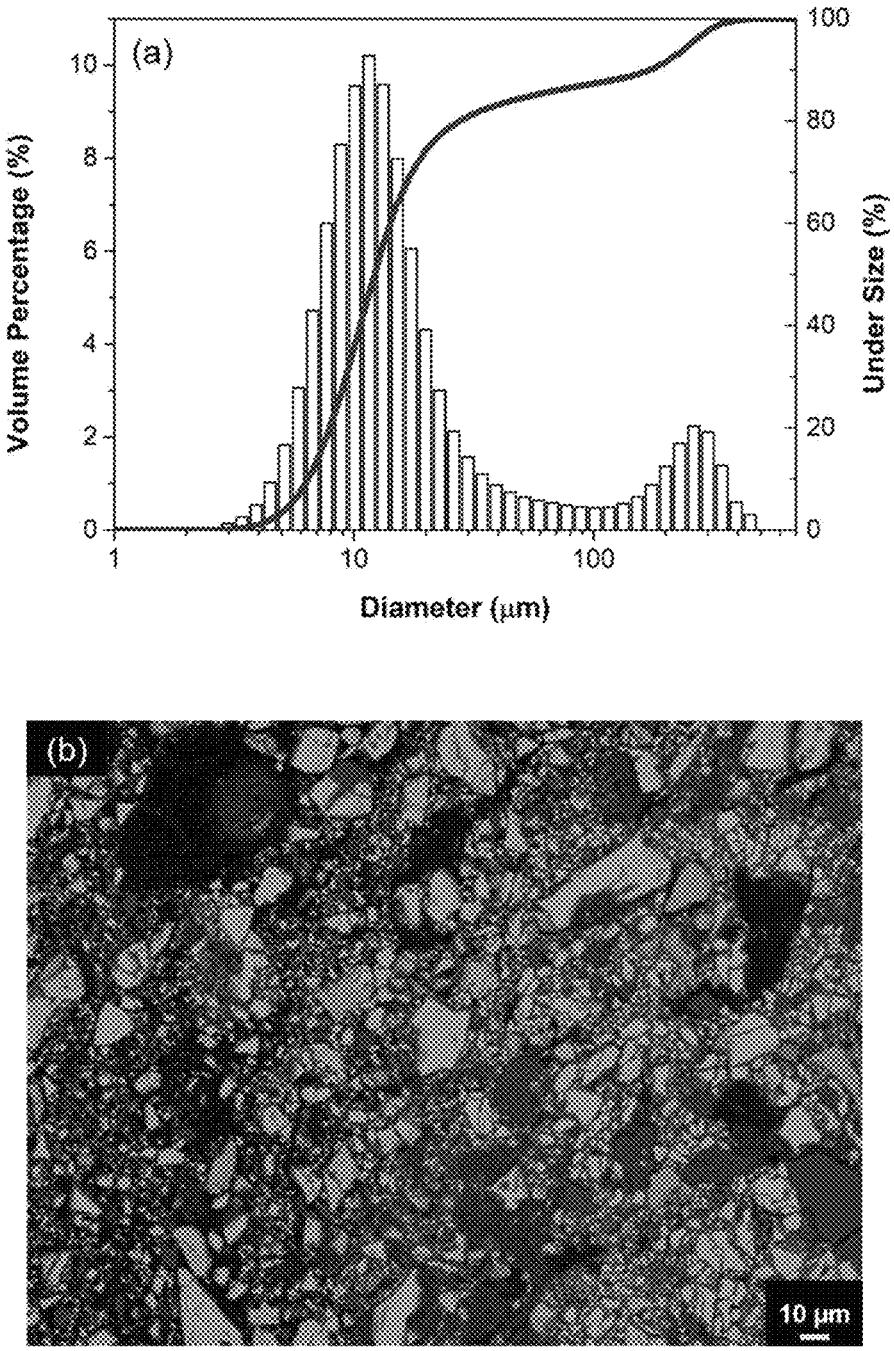
FIG. 4 shows (a) the particle size distribution of the Ni concentrate and (b) the morphology of the Ni concentrate used in samples treated according to embodiments of the process of the present disclosure and comparative treatments. The particle size distribution was determined by laser particle size analyzer and the morphology of the Ni concentrates by scanning electron microscopy (SEM).

A commercial Ni concentrate with 18.8 wt % Ni from Thompson, Manitoba, Canada was used as the raw material. The concentrate comprised 56% pentlandite (Pn), 21% pyrrhotite and pyrite, 5% chalcopyrite, and the remainder as gangue. FIG. 4 shows the particle size distribution of the Ni concentrate as determined by laser particle size analyzer and the morphology of the Ni concentrates as determined by scanning electron microscopy (SEM). Most particles have the size close to 10 μm, and the $d_{80}$ (by volume) of all the particles were 30 μm.

Thermal Treatment Experimental Setup

Figure 5:
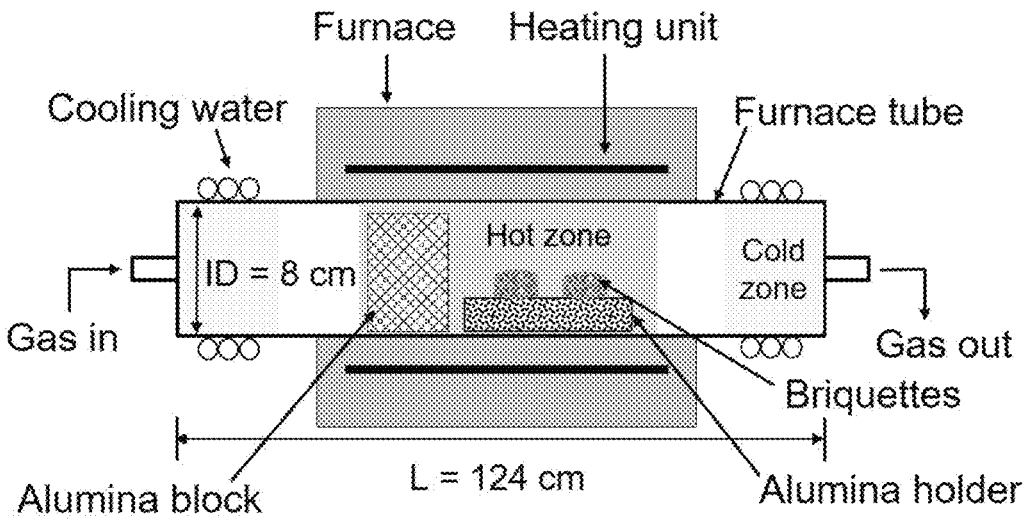
FIG. 5 is a schematic representation of the setup used to perform thermal treatments according to embodiments of the process of the present disclosure and comparative treatments.

Before the thermal treatment, metallic Fe (12 g, $d_{100}$=74 μm) and the Ni concentrate (10 g) were mixed and agglomerated into briquettes with approximately 16 mm D×12 mm H. Then, an alumina boat containing the briquettes was held in the cold zone of the furnace tube until the target temperature was reached in the hot zone. The briquettes were then moved to the hot zone and held for 30 min. Four tests were performed each using a different thermal treatment scheme. For Schemes 1 and 2 (comparative examples), the sample was heated at the target temperature for 30 min and then was quickly moved to the cold zone (temperature lower than 150° C.) for quenching. For Schemes 3 and 4 (examples according to the present technology), the sample was heated at the target temperature for 30 min and then slowly cooled according to two different procedures as will be detailed below. Cooling was performed by controlling the furnace cooling rate. Throughout the tests, high purity argon (>99.9%) was purged at a rate of 400 mL/min. FIG. 5 depicts the experimental setup.

Product Analysis

The microstructure of the thermal treatment products was examined by scanning electron microscopy (SEM). The compositions of the products were analyzed by an electron probe micro-analyzer (EPMA). The size of the generated FeNi alloy particles was estimated by image analysis of the obtained micrographs. The average Ni grade in the FeNi product and the maximum Ni recovery to the FeNi was calculated from the mass balance of nickel, iron, and sulfur in both alloy and sulfide.

Results and Analysis

Figure 6:
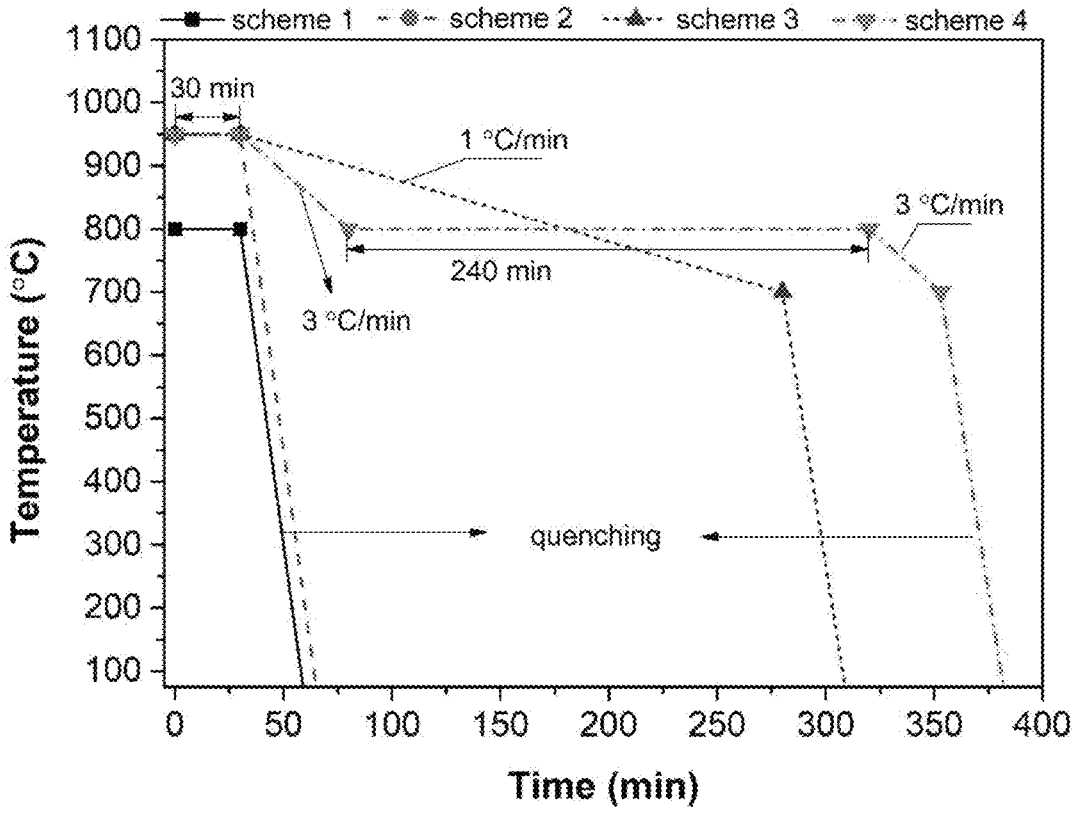
FIG. 6 is a diagram representing the processing temperature profile of samples submitted to a thermal treatment including a slow controlled cooling according to embodiments of the present disclosure (Schemes 3 and 4) in comparison to samples submitted to a thermal treatment with no controlled cooling (Schemes 1 and 2).

FIG. 6 shows the processing temperature profile for these four tests. Scheme 1 involved heating the sample at 800° C. for 30 min and then quenching it. In Scheme 2, the sample was treated at 950° C. for 30 min and then quenched. The FeNi generated through Scheme 1 had a small particle size but a high recovery of Ni. Scheme 2 yielded a large FeNi size but a low Ni recovery. At 950° C., the equilibrium mixture of Ni concentrates (10 g) and metallic Fe (12 g) converted into 50 wt % liquid (with 6.3 wt % Ni) and 50 wt % FeNi (with 12.4 wt % Ni). As a result, approximately 35% of Ni value was lost into the liquid. Due to the existence of the liquid, however, the FeNi particles grew faster as compared to that in a solid state at 800° C.

In Schemes 3 and 4, the samples were heated to 950° C. first to grow a large particle size and then slowly cooled down to 700 or 800° C. Surprisingly, the slow cooling allowed to gain a higher recovery, while slightly increasing the FeNi particle size.

Figure 7:
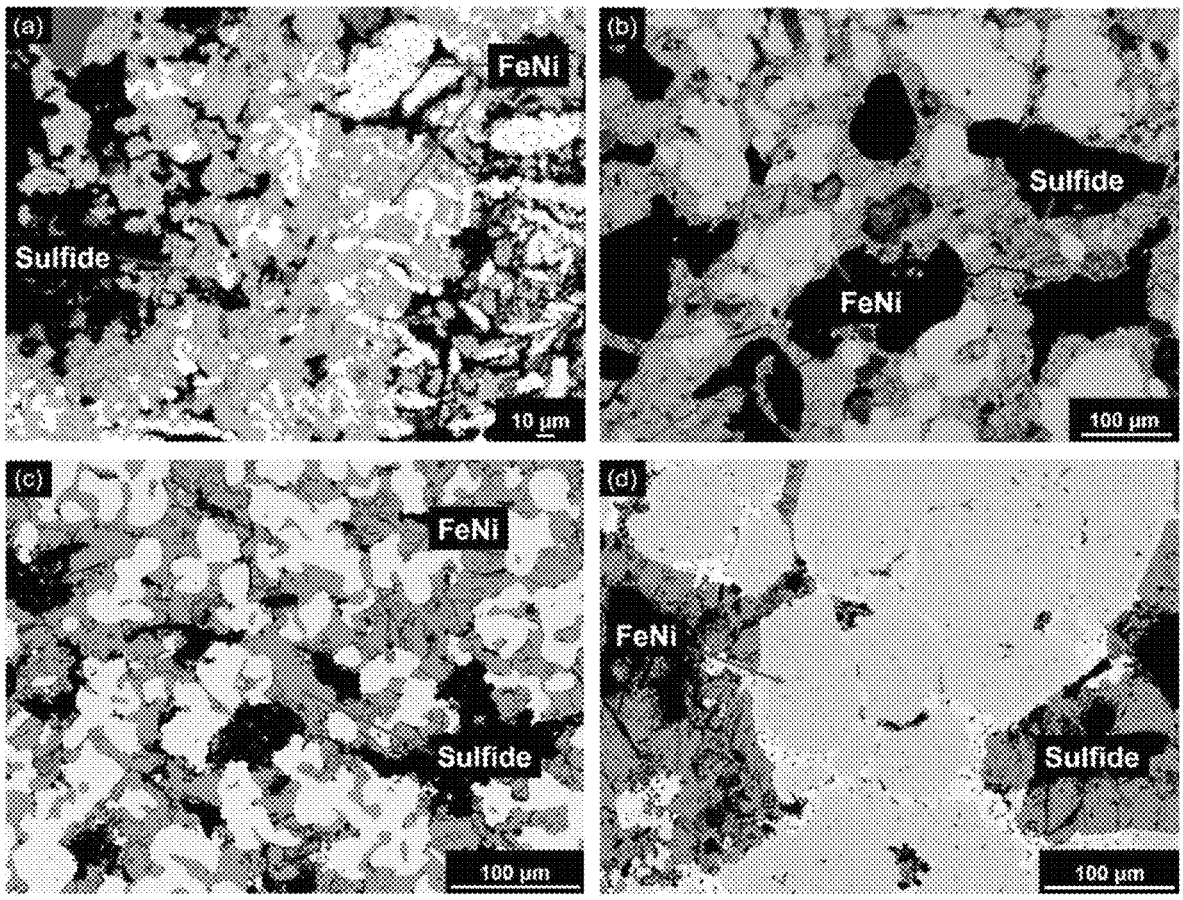
FIG. 7 represents Backscattered-Electron (BSE) images of the products resulting from the thermal treatments reported in FIG. 6: (a) products of Scheme 1, (b) products of Scheme 2, (c) products of Scheme 3, and (d) products of Scheme 4.

FIG. 7 shows BSE images of the products obtained after the thermal treatments according to Schemes 1 to 4. After thermal treatment, two phases exist: (1) FeNi (the bright phase) and (2) sulfide (the grey phase). As seen, the particle size of FeNi in FIGS. 6(*b*), (*c*) and (*d*) is significantly promoted as compared to that in FIG. 7(*a*). Image analysis (ImageJ) was applied to estimate the FeNi particle size. It was found that the $d_{80}$(FeNi) in FIG. 7(*a*) was only 45 μm, not an acceptable size for further liberation and separation. However, the $d_{80}$(FeNi) in FIGS. 7(*b*), (*c*) and (*d*) was 200, 290 and 500 μm, an improvement of 344%, 544% and 1011%, respectively. The liberation of FeNi particles from the host sulfide is accomplished by size reduction in a conventional comminution process such as ball mill or rod mill.

The formation of a liquid phase upon heating, facilitated the growth of FeNi particles due to the promotion of diffusion conditions. Scheme 3 and 4 treatments according to the present technology involved a slow cooling process between 950° C. and 700-800° C., which gave longer growth time for FeNi particles. Therefore, the achieved size is even larger than that by Scheme 2 treatment.

Figure 8:
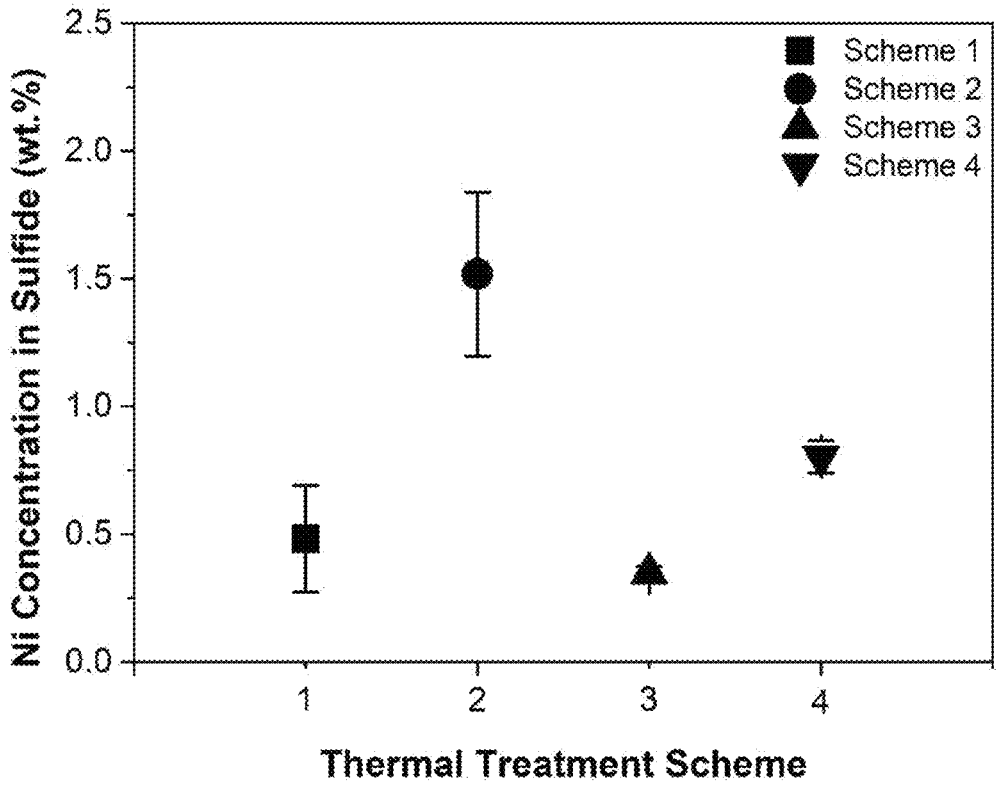
FIG. 8 represents the results of the determination by Electron probe micro-analysis (EPMA) of the Ni concentration in the sulfide material resulting from the thermal treatments presented in FIG. 6. The temperature profile of Schemes 1 to 4 is illustrated in FIG. 1.

In addition to favoring particle growth, the slow cooling process improves the recovery of Ni to FeNi, depleting Ni concentration in the resulting sulfide. As shown in FIG. 8, the Ni concentration in sulfide by Schemes 3 and 4 is 0.3 wt % and 0.8 wt % respectively, close to the level (0.5 wt %) achieved at 800° C. (Scheme 1), and much lower than the concentration (1.5 wt %) at 950° C. (Scheme 2).

Figure 9:
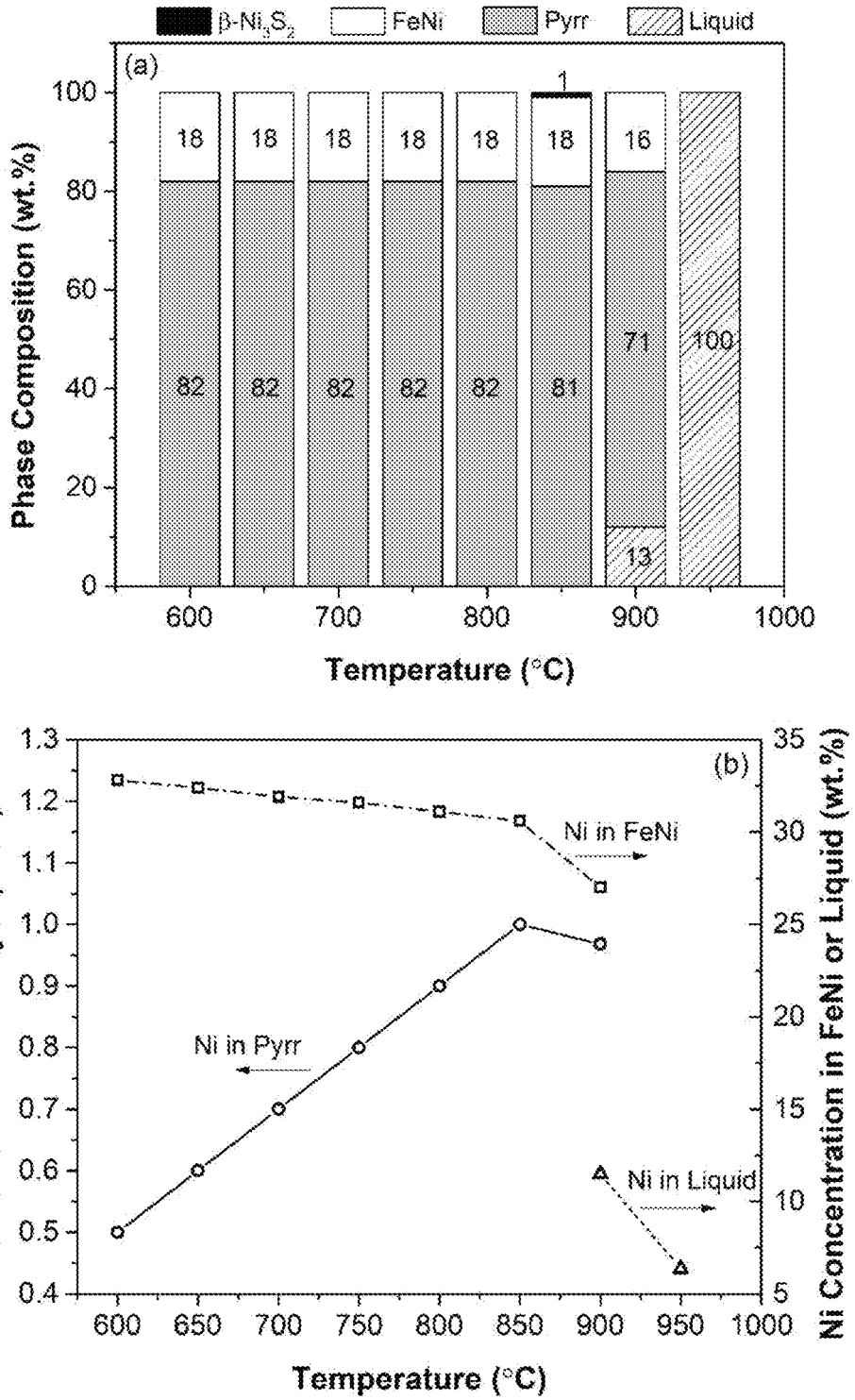
FIG. 9 represents the results of a thermodynamic analysis of the liquid phase transformation during cooling: (a) the mass percentage of each phase at various temperatures and (b) Ni concentration in the generated sulfide material, liquid, and FeNi. Pyrr is a Ni-lean iron sulfide.

During slow cooling, the liquid formed at 950° C. was unstable and underwent the phase transformation. A thermodynamic assessment of the liquid phase transformation was investigated, as shown in FIG. 9. As seen, from 950-900° C., the liquid phase converted into 16 wt % FeNi (with ~26 wt % Ni), 71 wt % pyrr (with ~0.9 wt % Ni), and 13 wt % liquid (with ~12 wt % Ni). Below 800° C., all the liquid was consumed with stable solid solutions generated, i.e., 82 wt % pyrr and 18 wt % FeNi. With decreasing temperature, the Ni concentration in the pyrr decreased while that in the FeNi increased.

Figure 10:
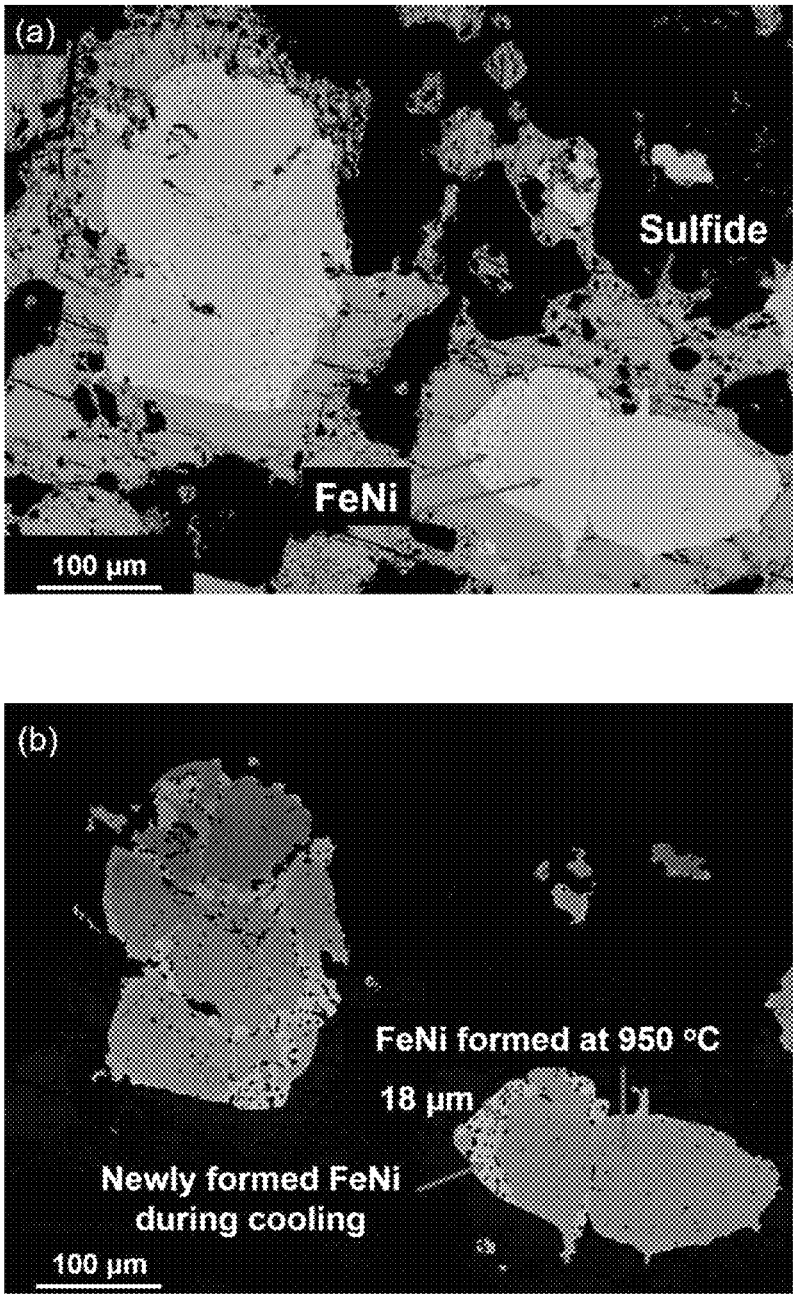
FIG. 10 represents (a) BSE images of the products resulting from the thermal treatment of Scheme 4 of FIG. 6; (b) contrast-enhanced image to show the Ni concentration gradient in FeNi.

FIG. 10 shows that the slow cooling causes small particles of newly formed FeNi to precipitate onto the larger FeNi particles created at 950° C. Due to the ~30 wt % Ni grade, the freshly formed FeNi looks brighter as compared to that generated at 950° C. (with 11 wt % Ni). A mass balance of Ni in the newly formed FeNi layer and in that created at 950° C. estimated an additional Ni recovery of 31%. The newly formed FeNi is believed to derive from the liquid phase transformation, as illustrated in FIG. 9. The net result is large composite particles of FeNi and high recovery of Ni. Furthermore, the freshly created FeNi holds the original FeNi particles (formed at 950° C. before cooling) together, significantly promoting the alloy particle size.

The four thermal treatment schemes are compared in Table 1 below. As seen, after thermal treatment by Scheme 4, a FeNi alloy containing a Ni grade of 15 wt % was generated, and the maximum Ni recovery to FeNi was 97%. The $d_{10}$ and $d_{80}$ of the generated FeNi were 173 and 500 μm, respectively, a recoverable size for the following liberation and separation.

TABLE 1

Ni grade, Ni recovery, and FeNi particle size by the investigated thermal treatment schemes. The Ni grade was determined by EPMA, and the recovery was calculated by the mass balance of Ni. Ni concentrate: 10 g; $d_{80}$ Ni concentrate: 30 μm; metallic Fe: 12 g; $d_{100}$ metallic Fe: 74 μm

| Thermal treatment process | Ni grade in FeNi (wt. %) | Ni recovery to FeNi (%) | $d_{10}$(FeNi) (μm) | $d_{80}$(FeNi) (μm) | $d_{100}$(FeNi) (μm) |
|---|---|---|---|---|---|
| Scheme 1 | 16 | 97 | 15 | 46 | 64 |
| Scheme 2 | 11 | 62 | 64 | 200 | 268 |
| Scheme 3 | 15 | 98 | 70 | 290 | 365 |
| Scheme 4 | 15 | 97 | 173 | 500 | 630 |

Example 3: Determination of the Minimum m Ratio of Iron to Ni-Containing Sulfide Required for Targeted Recovery for Different Types of Sulfide Sources Table 2 below provides the m ratio (ratio of iron to Ni-containing sulfide) calculated using the method explained in Example 1, for the targeted Ni recovery to FeNi shown in the last column of the table for different types of Ni-containing sulfide materials. The recovery and grade are for temperature of 700° C.

TABLE 2

| Sulfide material | m | Ni grade in FeNi (wt. %) | Ni recovery to FeNi (%) |
|---|---|---|---|
| Low nickel grade sulfide concentrate 4% Ni, 2%Cu, 42%Fe, 28%S | 0.05 | 50 | 36 |
| Furnace matte 36%Ni, 11%Cu, 1%Co, 33%Fe, 17%S | 0.05 | 53 | 61 |

TABLE 2-continued

| Sulfide material | m | Ni grade in FeNi (wt. %) | Ni recovery to FeNi (%) |
|---|---|---|---|
| Furnace matte 30%Ni, 1%Cu, 1%Co, 37%Fe, 27%S | 0.05 | 58 | 33 |
| Low nickel grade sulfide concentrate 4%Ni, 2%Cu, 42%Fe, 28% S | 0.19 | 21 | 90 |
| Furnace matte 36%Ni, 11%Cu, 1%Co, 33%Fe, 17%S | 0.3 | 43 | 90 |
| Furnace matte 30%Ni, 1%Cu, 1%Co, 37%Fe, 27%S | 0.24 | 59 | 90 |
| Furnace matte 47%Ni, 1.5%Cu, 0.8%Co, 20%Fe, 27%S | 0.5 | 60 | 90 |
| Furnace matte 65%Ni, 5%Cu, 0.7%Co, 5%Fe, 22%S | 0.69 | 57 | 90 |
| Furnace matte 40%Ni, 0.5%Co, 25%Fe, 34.5%S | 0.54 | 61 | 90 |
| Converter matte 56%Ni, 18%Cu, 2%Co, 2%Fe, 21%S | 0.89 | 43 | 90 |
| Converter matte 60%Ni, 1%Co, 1%Fe, 23%S | 0.66 | 63 | 90 |

Example 4: $SO_2$ Release Measurement

In this example, $SO_2$ release was determined for the following mixtures:

Mixture 1: a) Ni sulfide concentrate: assay % Ni=17.9, % Fe=30.8, % S=27.6, particle size not analyzed; and b) iron source: magnetite and activated carbon, particle size not analyzed.

Mixture 2: a) Ni sulfide concentrate: assay % Ni=18.8, % Fe=30.1, % S=29.9, particle size: $d_{80}$=30 μm by volume; and b) iron source: metallic Fe (>99% purity), particle size: $d_{100}$=74 μm/200 mesh.

The mixtures were treated using the following thermal treatments:

Mixture 1: 9.1 g Ni concentrate, 8.6 g magnetite, 2.3 g activated carbon, m=0.7; isothermal heating at 950° C. for 120 min and then quenched.

Mixture 2: 10 g Ni concentrate, 12 g metallic Fe, m=1.2; isothermal heating at 800° C. for 360 min and then quenched.

Hence, the mixtures were not cooled with a controlled cooling. However, due to the inert or reducing atmosphere and Fe—Ni—S phase relations, the $SO_2$ release for the two-step thermal treatment according to the present process is expected to be the same as for a thermal treatment with direct quenching.

An infrared continuous gas analyzer was employed to detect the concentration of the evolved $SO_2$ in the off gas during thermal treatment. The results were as follows:

Mixture 1: 3.6% of S in the Ni concentrate was detected as $SO_2$ in the off gas after 120 min at 950° C.

Mixture 2: 0.7% of S in the Ni concentrate was detected as $SO_2$ in the off gas after 360 min at 800° C.

Example 5: Ultramafic Ni Concentrate Treatment

In this example, the feasibility of nickel extraction from a low Ni grade (7 wt %) ultramafic Ni concentrate was validated by experiments. Two thermal treatment conditions were conducted.

Ultramafic Ni concentrate assay: % Ni=7, % Fe=19.6; % S=13.3. Iron source: metallic Fe (>99% purity), particle size: $d_{100}$=74 μm/200 mesh.

Condition 1: 2.6 g metallic Fe, 8.4 g ultramafic Ni concentrate, m=0.3; the mixture of metallic Fe and ultramafic concentrate was heated at 950° C. for 30 min and then cooled to 750° C. at 5° C./min, and maintained at 750° C. for 30 min, then quenched.

Result 1: % Ni in the remaining solid sulfide=1.4, % Ni in the FeNi=19-24, % Ni extraction=92, dso of FeNi grains=40 μm. The microscopic image is shown in FIG. 11.

Condition 2:1 g metallic Fe, 5 g ultramafic Ni concentrate, m=0.2; the mixture of metallic Fe, ultramafic Ni concentrate, and activated carbon was heated at 1000° C. for 30 min and cooled to 750° C. at 5° C./min and maintained at 750° C. for 30 min, then quenched.

Result 2: % Ni in the remaining solid sulfide=2.8, % Ni in the FeNi=26-30, % Ni extraction=85, dso of FeNi grains=34 μm. The microscopic image is shown in FIG. 12.

Figure 11:
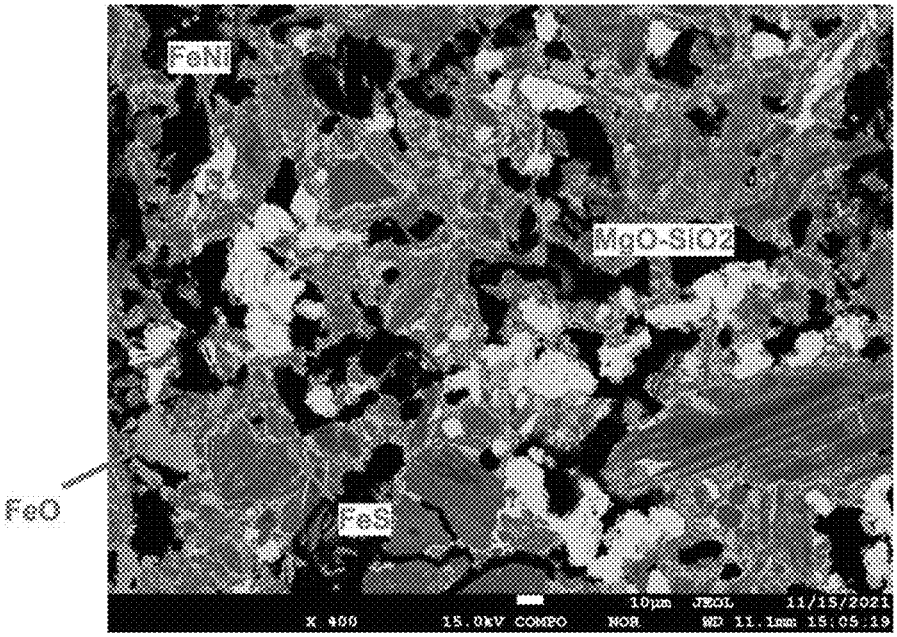
FIG. 11 is a representative microscopic image of the two-stage thermal treatment products of an ultramafic Ni concentrate and metallic Fe (metallic Fe/ultramafic Ni concentrate=0.3).
Figure 12:
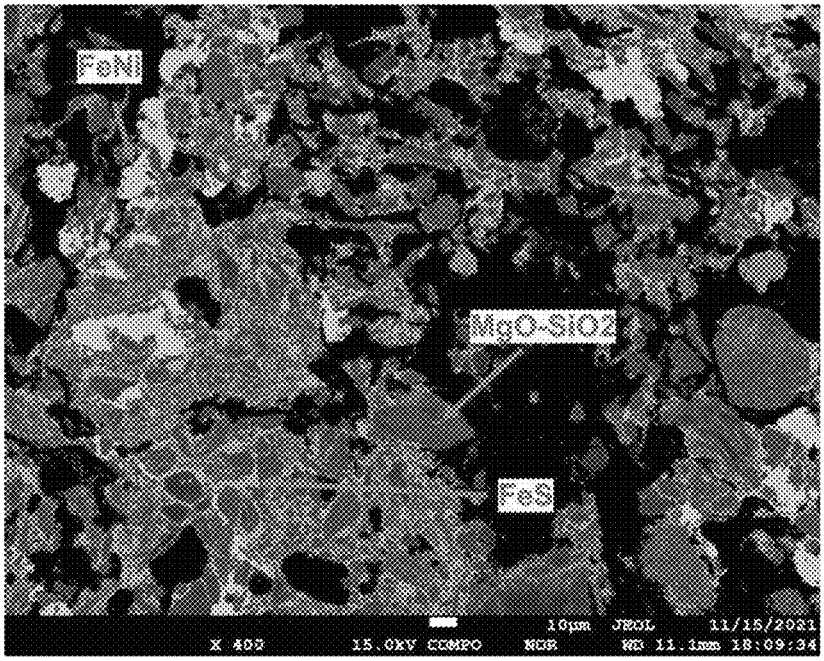
FIG. 12 is a representative microscopic image of the two-stage thermal treatment products of an ultramafic Ni concentrate and metallic Fe (metallic Fe/ultramafic Ni concentrate=0.2).

As seen in FIGS. 11 and 12, the treatment product may contain some gangue in the form of oxide and sulfide phases.

Example 6: Cooling Rate of 8° C./Min

In this example, a cooling rate of 8° C./min was studied to show the validity of nickel extraction via the two-step thermal treatment method.

Ni sulfide concentrate: assay % Ni=18.8, % Fe=30.1, % S=29.9, particle size: $d_{80}$=30 μm by volume. Iron source: metallic Fe (>99% purity), particle size: $d_{100}$=74 μm/200 mesh.

Condition: 2.35 g metallic Fe, 4.7 g Ni sulfide concentrate, m=0.5; the mixture of metallic Fe and Ni sulfide concentrate was heated at 900° C. for 30 min and cooled to 800° C. at 8° C./min and maintained at 800° C. for 30 min, further cooled to 700° C. at 8° C./min, then quenched.

Figure 13:
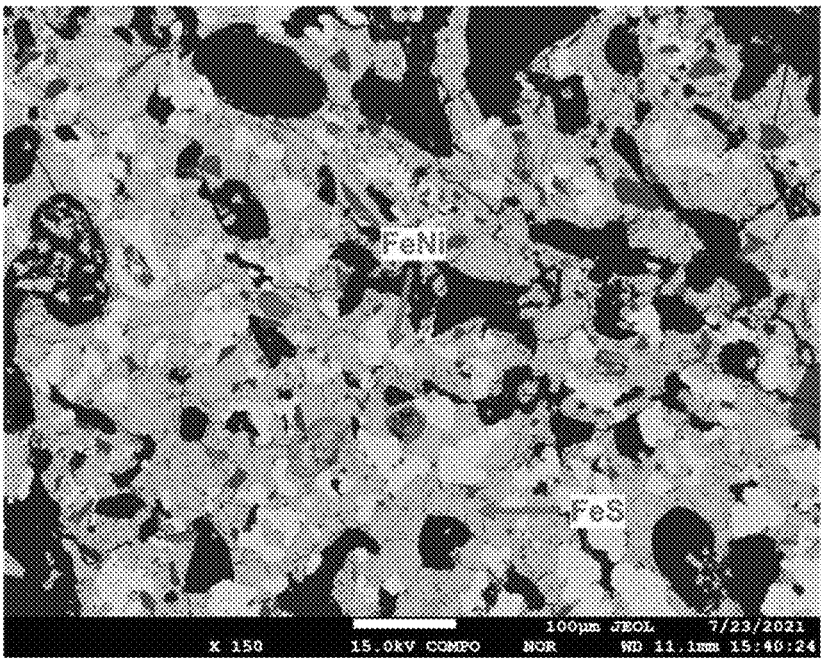
FIG. 13 is a representative microscopic image of the two-stage thermal treatment products of a high grade Ni concentrate and metallic Fe (metallic Fe/high Ni concentrate=0.5).

Result: % Ni in the remaining solid sulfide=1.5, % Ni in the FeNi=38, % Ni extraction=93, $d_{80}$ of FeNi grains=76 μm. The microscopic image is shown in FIG. 13.

The invention claimed is:

1. A process for producing ferronickel (FeNi) alloy particles from a nickel-containing sulfide material, comprising the steps of:

providing a nickel-containing sulfide material;

mixing and agglomerating the sulfide material and an iron-containing material to obtain a solid mixture comprising iron and the sulfide-material in agglomerated form;

heating the solid mixture in an inert or reducing atmosphere to a heating temperature below smelting at which the solid mixture is partially molten and obtaining a hot mixture comprising a nickel-containing liquid phase, gangue, and FeNi alloy particles;

controlled cooling of the hot mixture to increase the particle size and Ni content of said FeNi alloy particles and obtaining a processed material comprising said FeNi alloy particles having an increased particle size and an increased Ni content; and separating the FeNi alloy particles from the processed material.

2. The process according to claim 1, wherein the nickel-containing sulfide material derives from an ultramafic nickel sulfide ore and has a Ni content below 10 wt %.

3. The process according to claim 1, wherein the nickel-containing sulfide material comprises a Ni sulfide concentrate, Ni-rich matte or a mixture thereof.

4. The process according to claim 1, wherein the nickel-containing sulfide material comprises from about 2 wt % to about 65 wt % Ni.

5. The process according to claim 1, wherein the iron-containing material comprises metallic iron, an iron alloy, or recycled ferronickel-containing middling from a previous treatment.

6. The process according to claim 1, wherein the iron-containing material comprises at least one iron oxide and the iron oxide is mixed with the sulfide material in the presence of a reductant comprising coal, coke, activated carbon or any mixture thereof.

7. The process according to claim 1, wherein the iron-containing material comprises at least one iron oxide and the iron oxide is mixed with the sulfide material in the presence of a reducing atmosphere comprising hydrogen, natural gas, CO or any mixture thereof.

8. The process according to claim 1, further comprising analyzing the nickel-containing sulfide material to find out an iron, nickel and sulfur content thereof and determining the amount of iron-containing material to be mixed with the nickel-containing sulfide material based on the phase relations in the Fe—Ni—S system at the heating temperature to produce the partially molten mixture.

9. The process according to claim 1, wherein the iron-containing material is mixed with the sulfide material in a ratio of iron or iron equivalent to sulfide material of at least 0.05 on a mass basis.

10. The process according to claim 1, wherein the iron-containing material is mixed with the sulfide material in a ratio of iron or iron equivalent to sulfide material of from 0.05 to about 1.2 on a mass basis.

11. The process according to claim 1, wherein the hot mixture comprises from about 5 wt % to about 70 wt % of the nickel-containing liquid phase.

12. The process according to claim 1, wherein the heating temperature is from about 750° C. to about 1300° C.

13. The process according to claim 1, wherein heating the solid mixture is performed in an inert atmosphere or a reducing atmosphere comprising hydrogen, natural gas, carbon monoxide or any mixture thereof.

14. The process according to claim 1, wherein controlled cooling of the hot mixture comprises cooling at a rate of at most 10° C./min.

15. The process according to claim 1, wherein controlled cooling of the hot mixture comprises cooling from the heating temperature to an intermediate cooling temperature, and then cooling from the intermediate temperature to room temperature.

16. The process according to claim 15, wherein the intermediate cooling temperature is in the range from about 500° C. to about 800° C. and cooling from the heating temperature to the intermediate cooling temperature is performed at a rate of at most 10° C./min.

17. The process according to claim 15, further comprising maintaining the mixture at the intermediate temperature for a period of time.

18. The process according to claim 1, wherein the particle size of the FeNi alloy particles after cooling, expressed as dao by weight, increases by about 10% to about 200% compared to the particle size of the FeNi alloy particles, expressed as $d_{80}$ by weight, before cooling.

19. The process according to claim 1, wherein the separated FeNi alloy particles comprise from about 5 wt % to about 63 wt % Ni and/or are characterized by a particle size $d_{80}$ by weight of at least about 200 μm.

20. Ferronickel alloy particles obtained by the process according to claim 1.

21. A process for producing ferronickel (FeNi) alloy particles from a nickel-containing sulfide material, comprising the steps of:

providing a nickel-containing sulfide material;

mixing and agglomerating the sulfide material and an iron-containing material to obtain a solid mixture comprising iron and the sulfide-material in agglomerated form;

heating the solid mixture in an inert or reducing atmosphere to a heating temperature below smelting and obtaining a hot mixture comprising a nickel-containing phase, gangue, and FeNi alloy particles;

controlled cooling of the hot mixture to increase the particle size and Ni content of said FeNi alloy particles and obtaining a processed material comprising said FeNi alloy particles having an increased particle size and an increased Ni content; and separating the FeNi alloy particles from the processed material.

22. The process of claim 1, wherein the controlled cooling comprises cooling the hot mixture form a partially cooled material at a cooling rate of at most 10° C./min; and the process further comprises a subsequent cooling stage to cool the partially cooled material to a final temperature.

23. The process of claim 22, wherein the controlled cooling is performed at a constant cooling rate.

24. The process of claim 22, wherein the controlled cooling comprises an initial cooling stage followed by a temperature maintenance stage.

25. The process of claim 24, wherein the initial cooling stage is performed to reduce temperature from a starting temperature between 900° C. and 1300° C. to a partially cooled temperature between 500° C. and 800° C.

26. The process of claim 22, wherein the subsequent cooling stage is a quenching step where cooling is performed faster than the initial cooling stage.

* * * * *